US005397691A

United States Patent [19]

Takada et al.

[11] Patent Number: 5,397,691

[45] Date of Patent: Mar. 14, 1995

[54] SILVER HALIDE COLOR PHOTOGRAPHIC LIGHT-SENSITIVE MATERIAL

[75] Inventors: Kiyohito Takada; Kentaro Okazaki, both of Minami-ashigara, Japan

[73] Assignee: Fuji Photo Film Co., Ltd., Kanagawa, Japan

[21] Appl. No.: 69,101

[22] Filed: May 28, 1993

[30] Foreign Application Priority Data

May 29, 1992 [JP] Japan ..... 4-139351
May 29, 1992 [JP] Japan ..... 4-139402

[51] Int. Cl.[6] ..... G03C 1/09

[52] U.S. Cl. ..... 430/550; 430/384; 430/554; 430/555; 430/558

[58] Field of Search ..... 430/384, 385, 548, 550, 430/554, 555, 558

[56] References Cited

U.S. PATENT DOCUMENTS 4,791,053 12/1988 Ogawa ..... 430/581
5,215,871 6/1993 Sato et al. ..... 430/384

FOREIGN PATENT DOCUMENTS 467033 3/1992 Japan .

OTHER PUBLICATIONS

Research Disclosure # 307105, p. 866, Nov. 1989.

*Primary Examiner*—Hoa Van Le
*Attorney, Agent, or Firm*—Birch, Stewart Kolasch & Birch

[57] ABSTRACT

A silver halide color photo-graphic light-sensitive material having an excellent performance in a rapid processing and color reproduction and providing a stable photographic performance against a composition change in a processing solution is disclose, which comprises a support and provided thereon a photographic constitutional layer comprising each at least one layer of a light-sensitive silver halide emulsion layer containing a yellow dye-forming coupler, a light-sensitive silver halide emulsion layer containing a magenta dye-forming coupler, and a light-sensitive silver halide emulsion layer containing a cyan dye-forming coupler, and at least one non-light-sensitive layer, wherein the above silver halide emulsion layer containing the cyan dye-forming coupler contains (i) at least one of specific pyrroloazole cyan couplers, and (ii) (a) silver bromochloride grains having a silver chloride content of 90 mole % or more or silver chloride grains, each chemically sensitized with a gold compound or (b) silver bromochloride grains containing substantially no silver iodide and having a silver chloride content of 90 mole % or more and a silver bromide-rich phase on the grain surface or in the inside thereof having a silver bromide content larger by 5 mole % or more than those at the other portions.

17 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material, specifically to a silver halide color photographic light-sensitive material having an excellent processing performance and color reproducibility and providing stable photographic performance against compositional changes in the processing solutions of a continuous processing of a low processing solution replenishing-type, as well as having decreased sensitivity change due to aging of a coating solution and enabling a stable photographic performance to be obtained. Further, the present invention provides less desensitization stripes which are generated by pressures applied in a processing solution.

BACKGROUND OF THE INVENTION

In recent years, there have been increasing demands for improvement in color photographic papers as to rapid processing performance and accordingly much research has been done to this end. It is known that raising the silver chloride content of a silver halide emulsion leads to notable improvement in developing speed, as disclosed in, for example, International Patent WO87-04534. In the market place, the emulsions used for the color photographic paper are formulated to have a higher silver chloride content.

In these light-sensitive materials for color photographic papers, color reproducibility of the finished dye image as well as rapidity in processing is important in terms of quality. The performance of a color negative photographic film depends largely on the hue of the developed dyes which form the print image. The hue of the developed dyes also determines the broad color reproduction area, that is, a color print so obtained can have what true reproduced image can be formed based on the original to be reproduced. Silver halide color photographic light-sensitive print materials having excellent color reproducibility have been studied from various standpoints. In a conventional light-sensitive material for a color print, there is generally applied a color reproduction system based on the subtractive color process in which cyan, magenta and yellow colors are used as the primary three colors. The process is restricted by the absorption characteristics of the cyan, magenta and yellow dyes used, i.e., how truly and in what broad range the colors can be reproduced in the color print. Where the light absorption profile of the dye is broad and undesirable side-absorptions are involved, a color turbidity is generated.

In view of the above it is known that conventional phenol series or naphthol series couplers have problems in forming a cyan dye image with a usual light-sensitive material for a color print, since they have side-absorptions in the green and blue regions. Therefore, they are not preferred in reproducing the said colors, and a solution thereof has been desired.

An example of an unnecessary side-absorption deteriorating the color reproduction is that the green color of, for example, a green leaf which is photographed on a color negative film and reproduced on a color print inclines to a brownish green color in some cases.

As the means for solving this problem, 2,4-diphenylimidazoles described in European Patent 294,453A2 are proposed. In the dyes formed by these couplers, undesirable side-absorption in short wavelength regions is reduced compared with that of conventional dyes. Accordingly, they are preferable in terms of color reproduction.

However, in these couplers, the color reproduction is not necessarily sufficient and additionally, there remain the problems that in practical use coupling activity is low and that fastness to heat and light is poor. Accordingly, they are impractical.

The pyrazoloazole series couplers described in JP-A-64-553 (the term "JP-A" as used herein means an unexamined published Japanese patent) are improved as to side-absorption in short wavelength regions compared with that of conventional dyes, but those couplers do not always have sufficient color reproducibility and there remains the problem that color developing performance is notably low.

The development of a cyan coupler having an excellent color reproduction by the present inventors has resulted in finding that dyes having reduced unfavorable side-absorptions in the green and blue regions can be formed with the following pyrroloazole-type cyan dye-forming couplers having the specified substituent groups, and that great improvements in color reproduction can be achieved therewith.

However, the preparation and evaluation of color light-sensitive materials in which the cyan dye-forming coupler having this pyrroloazole primary nucleus is used in combination with a high silver chloride emulsion has resulted in the finding of a serious practical problem which has not been anticipated. That is, the silver halide color photographic light-sensitive material can surely provide a cyan dye image having a high color purity, but the various processing tests carried-out under retail market color lab, development processing conditions (a processing station) have revealed the problem of large changes (of the cyan dye portion) photographic performance due to compositional changes in processing solutions.

Further, detailed inspection of the cause of this composition change in the processing solution has revealed that the degree of mixing of the bleach-fixing solution into the developing solution corresponds to this change (of the cyan dye portion) in photographic performance.

Low replenishing and low discharging of processing solutions is the current trend from the viewpoint of environmental problems and overcoming the defects inherent in such processing methods is an important subject in developing a photographic light-sensitive material.

With respect to the above mixing of the bleach-fixing solution into the developing solution, it is almost impossible to completely prevent the mixing thereof, even by strict management for preventing such mixing at retail market labs (the processing station) because of the splash of the solutions. Further, another problem exists in that the amount of the bleach-fixing solution mixed into the developing solution is varied to a large extent from lab to lab, depending on the method of transport with rollers and squeezing in an automatic developing machine and the differences in processing amounts per unit time. The recent inclination toward low replenishing of solutions is accompanied by further increases in such mixing trend. As it is indispensable in practical use to give consistently stable photographic performance at any market labs, it is necessary to minimize the change in the photographic characteristics due to the degree of mixing of the bleach-fixing solution into the developing solution.

In this regard, a method in which the layer having a relatively high silver bromide content is formed on the outermost layer of a high silver chloride grain is disclosed in JP-A-62-254139, but such level meeting a sufficiently practical use has not been achieved, even with this technique.

It is disclosed in, for example, JP-A-60-222845 that in order to provide a high silver chloride emulsion with a high sensitivity, it is effective to allow the emulsion to have various grain constitutions in which a phase having a high silver bromide content is provided in the silver halide grains. However, the results of the investigations made by the present inventors revealed that continuous processing carried out for a silver halide light-sensitive material in which there is used a silver bromochloride emulsion which is highly sensitized by giving the above-mentioned silver bromide-rich phase; was liable to soften the gradation of the cyan color developed portion, particularly at the high density portion with the density of 1.8 or more. This is not preferable since it allows the black portion of an image formed thereon to incline to red and an image to become unstable. Further, it was found that the more the replenishing amount of a development processing solution was reduced, the more notable this tendency became. When the replenishing amount of the development processing solution is reduced, the substances eluted from the light-sensitive material, that is, the halide ions and other ions generated upon developing, and various additives contained in the light-sensitive material were increased in the accumulated amounts thereof, and the compositional change in the processing solution becomes notable. Accordingly, the above softening of the developed cyan color is assumed to be due to this compositional change.

Further, it is found that where the light-sensitive material in which the silver halide emulsion provided with a sliver bromide-rich phase is used is continuously processed, a so-called desensitization stripe in which a portion to which a pressure may be exerted in a processing solution is desensitized, the density thereof is lowered and it is liable to generate desensitization stripes that markedly damage image quality.

There is disclosed in JP-A-2-96150, a technique in which a high silver chloride emulsion provided with a silver bromide-localized phase and a specific processing can be combined to decrease the change in a photographic performances before and after continuous processing. However, the results of the investigations repeated by the present inventors reveal that the change in photographic performances can certainly be reduced, but not necessarily sufficiently and further the generation of the desensitization stripes as described above can not be decreased.

In the case of a light-sensitive material for a color photographic paper, many prints have to be presented at a short delivery date with stable and uniform photographic performances. Accordingly, the light-sensitive material is continuously processed with an automatic developing machine. There is also the problem that calcium deposited on rollers during processing damages the surface of the light-sensitive material and therefore, stable and uniform photographic performances can not be maintained.

Calcium which may deposit on rollers during processing is released from the light-sensitive material (contained mainly in gelatin) to the processing solutions. Therefore, it is desirable to reduce the calcium content in the light-sensitive material as much as possible. Meanwhile, there exists the problem of deterioration of emulsion sensitivity including a coating solution, prepared by using gelatin, the calcium content of which is reduced as much as possible, upon several hours storage; particularly in the case of a coating solution comprising a red-sensitive emulsion, spectrally sensitized to a red color region, and a cyan dye-forming coupler. The reduction in calcium content required to overcome the instability in manufacturing performance and the technical development therefor was necessary.

SUMMARY OF THE INVENTION

An object of the present invention is to provide a silver halide color photographic light-sensitive material having a high sensitivity, excellent performance in a rapid processing and color reproduction and providing stable photographic performance due to compositional changes in processing solutions in a low replenishing process and in which a desensitization stripe is not readily generated when the continuous processing is carried out.

Another object of the present invention is to provide a silver halide color photographic light-sensitive material which avoids the problem of calcium being deposited on a roller during processing and in which an emulsion having less sensitivity reduction during the storage of a coating solution is used.

The intensive investigations made by the present inventors in order to solve the above problems have resulted in a finding that the conventional phenol series cyan couplers for color light-sensitive materials for prints can be replaced with a pyrroloazole-type cyan coupler having the specific substituent mentioned below to prevent the softening of a developed cyan color after continuous processing and furthermore decrease the occurence of desensitization stripes even if the high silver chloride emulsion to which a silver bromide-rich phase is provided for a high sensitization would be used. Further, it has been found that the desensitization stripe in the continuous processing can be reduced further by using this cyan coupler and markedly decreasing the calcium content in the photographic constitutional layers.

That is, the present invention is to provide a silver halide color photographic light-sensitive material comprising a support and provided thereon a photographic constitutional layer comprising each at least one layer of a light-sensitive silver halide emulsion layer containing a yellow dye-forming coupler, a light-sensitive silver halide emulsion layer containing a magenta dye-forming coupler, and a light-sensitive silver halide emulsion layer containing a cyan dye-forming coupler, and at least one non-light-sensitive layer, wherein the above silver halide emulsion layer containing a cyan dye-forming coupler contains (i) at least one of the pyrroloazole-type cyan couplers represented by the following Formula (Ia), and (ii) (a) silver bromochloride grains having a silver chloride content of 90 mole % or more or silver chloride grains, each chemically sensitized with a gold compound or (b) silver bromochloride grains containing substantially no silver iodide and having a silver chloride content of 90 mole % or more and a silver bromide-rich phase on the grain surface or in the inside thereof having a silver bromide content larger by 5 mole % or more than those at the other portions:

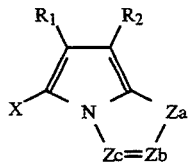

Formula (Ia)

wherein Za represents —NH— or —CH($R_3$)—, and Zb and Zc each represent —C($R_4$)= or —N=; $R_1$, $R_2$ and $R_3$ each represent an electron attractive group having a Hammett's substituent constant $\sigma_p$ of 0.20 or more, provided that the sum of the $\sigma_p$ values of $R_1$ and $R_2$ is 0.65 or more; $R_4$ represents a hydrogen atom or a substituent, provided that when two $R_4$'s are present in the formula, they may be the same or different; X represents a hydrogen atom or a group capable of splitting off upon a reaction with an oxidation product of an aromatic primary amine color developing agent; the group represented by $R_1$, $R_2$, $R_3$, $R_4$ or X may become a divalent group and combine to form a dimer or higher polymer or bond to a high molecular chain to form a homopolymer or a copolymer.

Further, the present invention is to provide a silver halide color photographic light-sensitive material characterized by that the maximum amount of calcium contained in the above photographic constitutional layer is 15 mg/m$^2$ or less, preferably 10 mg/m$^2$ or less, and most preferably 8 mg/m$^2$ or less per m$^2$ of the silver halide color photographic material.

In the present invention, the calcium content in the silver halide color photographic light-sensitive material depends on the calcium content in the gelatin, used primarily as a binder. One of the major characteristics in the present invention resides in that gelatin having a reduced calcium content is used to prevent the problem of calcium being deposited on a roller during processing and the reduction in sensitivity of an emulsion during the storage of a coating solution. The use of the cyan dye-forming coupler of the present invention makes it possible to use gelatin in which the calcium content is reduced as much as possible.

Calcium of 16 mg/m$^2$ or more is usually present in the light-sensitive material, unless gelatin from which calcium is especially removed is used. In general, an ion exchange resin and a dialysis treatment are used for removing calcium contained in gelatin.

DETAILED DESCRIPTION OF THE INVENTION

The compound of the present invention will be described below in detail.

To be specific, the pyrroloazole-type cyan dye-forming coupler of the present invention represented by Formula (Ia) is represented by Formulas (IIa) to (VIIIa):

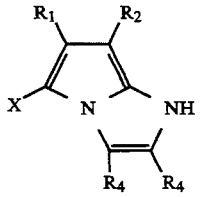

(IIa)

-continued

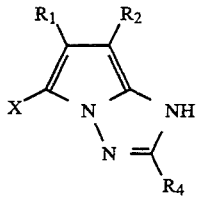

(IIIa)

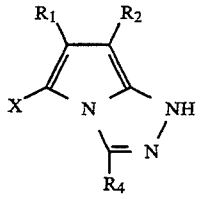

(IVa)

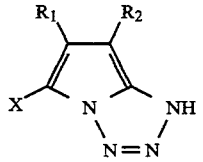

(Va)

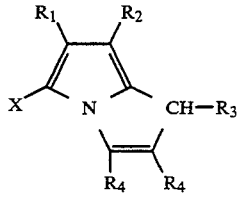

(VIa)

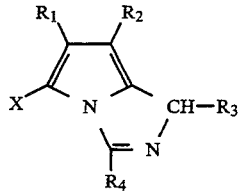

(VIIa)

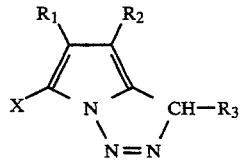

(VIIIa)

In Formulas (IIa) to (VIIIa), $R_1$, $R_2$, $R_3$, $R_4$ and X are synonymous with $R_1$, $R_2$, $R_3$, $R_4$ or X in Formula (Ia).

In the present invention, the cyan coupler represented by Formula (IIa), (IIIa) or (IVa) is preferred and the cyan coupler represented by Formula (IIIa) is particularly preferred.

In the cyan coupler of the present invention, $R_1$, $R_2$ and $R_3$ each are the electron attractive groups having the Hammett's substituent constant $\sigma_p$ value of 0.20 or more, and the total of the $\sigma_p$ values of $R_1$ and $R_2$ of 0.65 or more. The total of the $\sigma_p$ values of $R_1$ and $R_2$ is preferably 0.70 or more and the upper limit thereof is not more than 1.8.

$R_1$, $R_2$ and $R_3$ each are the electron attractive group having the $\sigma_p$ value of 0.20 or more, preferably 0.35 or more, and more preferably 0.60 or more. The upper limit thereof is 1.0 or less. The Hammett's rule is the rule of thumb which was proposed by L. P. Hammett in 1935 in order to quantitatively discuss the affects exerted to a reaction or equilibrium of a benzene derivative by a substituent. In these days, the propriety thereof is widely accepted.

The $\sigma_p$ value and $\sigma_m$ value are available as the substituent constant obtained according to the Hammett's rule and the values thereof are described in many general publications. They are described in, for example, "Lange's Handbook of Chemistry" vol. 12, edited by J. A. Dean, 1979 (McGraw-Hill) and "Chemical Region, Extra Edition" No. 122, pp. 96 to 103, 1979 (Nankohdo). In the present invention, $R_1$, $R_2$ and $R_3$ are regulated by Hammett's substituent constant $\sigma_p$ value but this does not mean that they are limited to the substituents the $\sigma_p$ values of which are described in these publications. Even if the $\sigma_p$ values of the groups would not be described in the publications, they are naturally included in the scope of the present invention as long as they are included in the above range when they are measured according to the Hammett's rule.

There can be enumerated as the concrete examples of $R_1$, $R_2$ and $R_3$ which are the electron attractive groups having the $\sigma_p$ values of 0.20 or more, an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted with the other electron attractive group having the $\sigma_p$ value of 0.20 or more, a heterocyclic group, a halogen atom, an azo group, and a selenocyanate group. Of these substituents, the groups capable of further having the substituents may further have the substituents given for the groups defined for $R_4$. The groups represented by $R_1$, $R_2$ and $R_3$ preferably have 1 to 36 carbon atoms.

To explain $R_1$, $R_2$ and $R_3$ in more details, there can be enumerated as the electron attractive groups having the $\sigma_p$ values of 0.20 or more, an acyl group (for example, acetyl, 3-phenylpropanoyl, benzoyl, and 4-dodecyloxybenzoyl), an acyloxy group (for example, acetoxy), a carbamoyl group (for example, carbamoyl, N-ethylcarbamoyl, N-phenylcarbamoyl, N,N-dibutylcarbamoyl, N-(2-dodecyloxyethyl)carbamoyl, N-(4-n-pentadecanamide)phenylcarbamoyl, N-methyl-N-dodecylcarbamoyl, and N-[3-(2,4-di-t-amylphenoxy)propyl]carbamoyl), an alkoxycarbonyl group (for example, methoxycarbonyl, ethoxycarbonyl, iso-propyloxycarbonyl, tert-butyloxycarbonyl, iso-butyloxycarbonyl, butyloxycarbonyl, dodecyloxycarbonyl, octadodecyloxycarbonyl, diethylcarbamoylethoxycarbonyl, perfluorohexylethoxycarbonyl, and 2-decylhexyloxycarbonylmethoxycarbonyl), an aryloxycarbonyl group (for example, phenoxycarbonyl and 2,5-di-amylphenocycarbonyl), a cyano group, a nitro group, a dialkylphosphono group (for example, dimethylphosphono), a diarylphosphono group (for example, diphenylphosphono), a dialkoxyphospholyl group (for example, dimethoxyphospholyl), a diarylphosphinyl group, for example, diphenylphosphinyl), an alkylsulfinyl group (for example, 3-phenoxypropylsulfinyl), an arylsulfinyl group (for example, 3-pentadecylphenylsulfinyl), an alkylsulfonyl group (for example, methanesulfonyl and octanesulfonyl), an arylsulfonyl group (for example, benzenesulfonyl and toluenesulfonyl), a sulfonyloxy group (for example, methanesulfonyloxy and toluenesulfonyloxy), an acylthio group (for example, acetylthio and benzoylthio), a sulfamoyl group (for example, N-ethylsulfamoyl, N,N-dipropylsufamoyl, N-(2-dodecyloxyethyl)sulfamoyl, N-ethyl-N-dodecylsulfamoyl, and N,N-diethylsulfamoyl), a thiocyanate group, a thiocarbonyl group (for example, methylthiocarbonyl and phenylthiocarbonyl), a halogenated alkyl group (for example, trifluoromethyl and heptafluoropropyl), a halogenated alkoxy group (for example, trifluoromethyloxy), a halogenated aryloxy group (for example, pentafluorophenyloxy), a halogenated alkylamino group (for example, N,N-di-(trifluoromethyl)amino), a halogenated alkylthio group (for example, difluoromethyl and 1,1,2,2-tetrafluoroethylthio), an aryl group substituted with the other electron attractive groups having the $\tau_p$ value of 0.20 or more (for example, 2,4-dinitrophenyl, 2,4,6-trichlorophenyl, and pentachlorophenyl), a heterocyclic group (for example, 2-benzoxazolyl, 2-benzothiazolyl, 1-phenyl- 2-benzimidazolyl, pyrazolyl, 5-chloro-1-tetraazolyl, and 1-pyrrolyl), halogen atom (for example, a chlorine atom and a bromine atom), an azo group (for example, phenylazo), and a selenocyanate group.

To enumerate the representative $\sigma_p$ values of the electron attractive groups, they are a cyano group (0.66), a nitro group (0.78), a trifluoromethyl group (0.54), an acetyl group (0.50), a trifluoromethanesulfonyl group (0.92), a methanesulfonyl group (0.72), a benzenesulfonyl group (0.70), a methanesulfinyl group (0.49), a carbamoyl group (0.36), a methoxycarbonyl group (0.45), a pyrazolyl group (0.37), a methanesulfonyloxy group (0.36), a dimethoxyphospholyl group (0.60), and a sulfamoyl group (0.57).

There can be enumerated as the preferred $R_1$, $R_2$ and $R_3$, an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenated alkyl group, a halogenated alkoxy group, a halogenated alkylthio group, a halogenated aryloxy group, a halogenated aryl group, an aryl group substituted with two or more nitro groups, and a heterocyclic group. Further preferred are an acyl group, an alkoxycarbonyl group, an aryloxycarbonyl group, a nitro group, a cyano group, an arylsulfonyl group, a carbamoyl group, and a halogenated alkyl group. More preferred are a cyano group, an alkoxycarbonyl group, an aryloxycarbonyl group, and a halogenated alkyl group.

Particularly preferred are a cyano group, a trifluoromethyl group, a straight-chain or branched unsubstituted alkoxycarbonyl group, an alkoxycarbonyl group substituted with a carbamoyl group, an alkoxycarbonyl group having an ether bond, or an aryloxycarbonyl group that is either unsubstituted or substituted with an alkyl group or an alkoxy group.

The combination of $R_1$ and $R_2$ is preferably that $R_1$ is a cyano group and $R_2$ is any of a trifluoromethyl group, a straight-chain or branched unsubstituted alkoxycarbonyl group, an alkoxycarbonyl group substituted with a carbamoyl group, an alkoxycarbonyl group having an ether bond, and an aryloxycarbonyl group that is either unsubstituted or substituted with an alkyl group or an alkoxy group.

$R_4$ represents a hydrogen atom or a substituent (including an atom) preferably having 1 to 36 carbon atoms, and there can be enumerated as the substituent, a halogen atom, an aliphatic group, an aryl group, a heterocyclic group, an alkoxy group, an aryloxy group, a heterocyclic oxy group, an alkyl, aryl or heterocyclic thio group, an acyloxy group, a carbamoyloxy group, a silyloxy group, a sulfonyloxy group, an acylamino group, an alkylamino group, an arylamino group, a ureido group, a sulfamoylamino group, an alkenyloxy group, a formyl group, an alkyl, aryl or heterocyclic acyl group, an alkyl, aryl or heterocyclic sulfonyl group, an alkyl, aryl or heterocyclic sulfinyl group, an alkyl, aryl or heterocyclic oxy carbonyl group, an alkyl, aryl or heterocyclic oxy carbonylamino group, a sulfonamide group, a carbamoyl group, a sulfamoyl group, a phosphonyl group, a sulfamide group, an imide group, an azolyl group, a hydroxy group, a cyano group, a carboxy group, a nitro group, a sulfo group, and an unsubstituted amino group. The alkyl group, aryl group or heterocyclic group contained in these groups may further be substituted with the substituents exemplified for $R_4$.

To be more detailed, $R_4$ represents a hydrogen atom, a halogen atom (for example, a chlorine atom and a bromine atom), an aliphatic group (for example, a linear or branched alkyl group having 1 to 36 carbon atoms, an aralkyl group, an alkenyl group, an alkynyl group, a cycloalkyl group, and a cycloalkenyl group, and to be detailed, for example, methyl, ethyl, propyl, isopropyl, t-butyl, tridecyl, 2-methanesulfonylethyl, 3-(3-pentadecylphenoxy)propyl, 3-[4-{2-[4-(4-hydroxyphenylsulfonyl)phenoxy]dodecanamide}phenyl]propyl, 2-ethoxytridecyl, trifluoromethyl, cyclopentyl, and 3-(2,4-di-t-amylphenoxy)propyl), an aryl group (preferably having the carbon atoms of 6 to 36, for example, phenyl, naphthyl, 4-hexadecyloxyphenyl, 4-t-butylphenyl, 2,4-di-t-amylphenyl, 4-tetradecanamidephenyl, and 3-(2,4-tertamylphenoxyacetoamide)phenyl), a heterocyclic group (for example, 3-pyridyl, 2-furyl, 2-thienyl, 2-pyridyl, 2-pyrimidinyl, and 2-benzothiazolyl), an alkoxy group (for example, methoxy, ethoxy, 2-methoxyethoxy, 2-dodecylethoxy, and 2-methanesulfonylethoxy), an aryloxy group (for example, phenoxy, 2-methylphenoxy, 4-tert-butylphenoxy, 2,4-di-tert-amylphenoxy, 2-chlorophenoxy, 4-cyanophenoxy, 3-nitrophenoxy, 3-t-butyloxycarbamoylphenoxy, and 3-methoxycarbamoylpenoxy), a heterocyclic oxy group (for example, 2-benzimidazolyloxy, 1-phenyltetrazole-5-oxy, and 2-tetrahydropyranyloxy), an alkyl, aryl or heterocyclic thio group (for example, methylthio, ethylthio, octylthio, tetradecylthio, 2-phenoxyethylthio, 3-phenoxypropylthio, 3-(4-tert-butylphenoxy)propylthio, phenylthio, 2-butoxy-5-tert-octyolphenylthio, 3-pentadecylphenylthio, 2-carboxyphenylthio, 4-tetradecaneamidephenylthio, 2-benzothiazolylthio, 2,4-diphenoxy-1,3,4-triazole-6-thio, and 2-pyridylthio), an acyloxy group (for example, acetoxy and hexadecanoyloxy), a carbamoyloxy group (for example, N-ethyl-carbamoyloxy and N-phenylcarbamoyloxy), a silyloxy group (for example, trimethylsilyloxy and dibutylmethylsilyloxy), a sulfonyloxy group (for example, dodecylsulfonyloxy), an acylamino group (for example, acetoamide, benzamide, tetradecaneamide, 2-(2,4-tert-amylphenoxy)acetoamide, 2-[4-(4-hydroxyphenylsulfonyl)phenoxy]decaneamide, isopentadecaneamide, 2-(2,4-di-t-amylphenoxy)butaneamide, and 4-(3-t-butyl-4-hydroxyphenoxy)butaneamide), an alkylamino group (for example, methylamino, butylamino, dodecylamino, dimethylamino, diethylamino, and methylbutylamino), an arylamino group (for example, phenylamino, 2-chloroanilino, 2-chloro-5-tetradecaneamideanilino, N-acetylanilino, 2-chloro-5-[α-2-tert-butyl-4-hydroxyphenoxy)docaneamide]anilino, and 2-chloro-5-dodecyloxycarbonylanilino), a ureido group (for example, methylureido, phenylureido, N,N-dibutylureido, and dimethylureido), a sulfamoylamino group (for example, N,N-dipropylsulfamoylamino and N-methyl-N-decylsulfamoylamino), an alkenyloxy group for example, propenyloxy), a formyl group, an alkyl, aryl or heterocyclic acyl group (for example, acetyl, benzoyl, 2,4-di-tert-amylphenylacetyl, 3-phenylpropanoyl, and 4-dodecyloxybenzoyl), an alkyl, aryl or heterocyclic sulfonyl group (for example, methanesulfonyl, octanesulfonyl, benzenesulfonyl, and tluenesulfonyl), an alkyl, aryl or heterocyclic sulfinyl group (for example, octanesulfinyl, dodecanesulfinyl, phenylsulfinyl, 3-pentadecylphenylsulfinyl, and 3-phenoxypropylsulfinyl), an alkyl, aryl or heterocyclic oxy carbonyl group (for example, methoxycarbonyl, butoxycarbonyl, dodecyloxycarbonyl, octadecyloxycarbonyl, phenyloxycarbonyl, and 2-pentadecyloxycarbonyl), an alkyl, aryl or heterocyclic oxy carbonylamino group (for example, methoxycarbonylamino, tetradecyloxycarbonylamino, phenoxycarbonylamino, and 2,4-di-tert-butylphenoxycarbonylamino), a sulfonamide group (for example, methanesulfonamide, hexadecanesulfonamide, benzenesulfonamide, p-toluenesulfonamide, octadecaneuslfonamide, and 2-methoxy-5-tert-butylbenzenesulfonamide), a carbamoyl group (for example, N-ethylcarbamoyl, N,N-dibutylcarbamoyl, N-(2-dodecyloxyethyl), carbamoyl, N-methyl-N-dodecylcarbamoyl, and N-[3-(2,4-di-tert-amylphenoxy)propyl]carbamoyl), a sulfamoyl group (for example, N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a phosphonyl group (for example, phenoxyphosphonyl, octyloxyphosphonyl, and phenylphosphonyl), a sulfamide group (for example, dipropylsulfamoylamino), an imide group (for example, N-succinimide, hydantoinyl, N-phthalimide, and 3-octadecenylsuccinimide), an azolyl group (for example, imidazolyl, pyrazolyl, 3-chloropyrazle-1-yl, and triazolyl), a hydroxy group, a cyano group, a carboxy group, a nitro group, a sulfo group, and an unsubstituted amino group.

There can be preferably enumerated as $R_4$, an alkyl group, an aryl group, a heterocyclic group, a cyano group, a nitro group, an acylamino group, an arylamino group, a ureido group, a sulfamoylamino group, an alkylthio group, an arylthio group, a heterocyclic thio group, an alkoxycarbonylamino group, an aryloxycarbonylamino group, a sulfonamide group, a carbamoyl group, a sulfamoyl group, a sulfonyl group, an alkoxycarbonyl group, an aryloxycarbonyl group, a heterocyclic oxy group, an acyloxy group, a carbamoyloxy group, an imide group, a sulfinyl group, a phosphonyl group, an acyl group, and an azolyl group.

Further preferred are an alkyl group and an aryl group. More preferred is the alkyl or aryl group having at least one alkoxy group, sulfonyl group, sulfamoyl group, carbamoyl group, acylamide group, or sulfonamide group as a substituent. Particularly preferred is the alkyl or aryl group having at least one acylamide group or sulfonamide group as a substituent.

In Formula (Ia), X represents a hydrogen atom or the group (hereinafter referred to as a splitting group) which is split off when the coupler reacts with the oxidation product of an organic primary amine color developing agent. When X represents the splitting group, the splitting group is a halogen atom, an aromatic azo group, an alkyl, aryl or heterocyclic group, alkyl- or arylsulfonyl group, arylsulfinyl group, alkoxy, aryloxy or heterocyclic oxy carbonyl group, aminocarbonyl group, or alkyl, aryl or heterocyclic carbonyl group, each bonded to a coupling site via an oxygen, nitrogen, sulfur or carbon atom, or a heterocyclic group bonded to the coupling site via a nitrogen atom in the heterocycle. There are given, for example, a halogen atom, an alkoxy group, an aryloxy group, an acyloxy group, an alkyl- or arylsulfonyloxy group, an acylamino group, an alkyl- or arylsulfonamide group, an alkoxycarbonyloxy group, an aryloxycarbonyloxy group, an alkyl, aryl or heterocyclic thio group, a carbamoylamino group, an arylsulfinyl group, an arylsulfonyl group, a 5-membered or 6-membered nitrogen-containing heterocyclic group, an imide group, and an arylazo group. The alkyl group, aryl group or heterocyclic group contained in these splitting groups may further be substituted with the substitutents enumerated for $R_4$. When these substituents are two or more, they may be the same different. These groups may further have the substituents enumerated for $R_4$. The group represented by X preferably has 1 to 12 carbon atoms.

To be more detailed, the splitting group is a halogen atom (for example, a fluorine atom, a chlorine atom and a bromine atom), an alkoxy group (for example, ethoxy, dodecyloxy, methoxyethylcarbamoylmethoxy, carboxypropyloxy, methylsulfonylethoxy, and ethoxycarbonylmethoxy), an aryloxy group (for example, 4-methylphenoxy, 4-chlorophenoxy, 4-methoxyphenoxy, 4-carboxyphenoxy, 3-ethoxycarboxyphenoxy, 3-acetylaminophenoxy, and 2-carboxyphenoxy), an acyloxy group (for example, acetoxy, tetradecanoyloxy, and benzolyoxy), an alkyl- or arylsulfonyloxy group (for example, methanesulfonyloxy and toluenesulfonyloxy), an acylamino group (for example, dicholoracetylamino and heptafluorobutylylamino), an alkyl- or arylsulfonamide group (for example, methanesulfonamide, trifluoromethanesulfonamide, and p-tolunesulfonylamino), an alkoxycarbonyloxy group (for example, ethoxycarbonyloxy and benzyloxycarbonyloxy), an aryloxycarbonyloxy group (for example, phenoxycarbonyloxy), an alkyl, aryl or heterocyclic thio group (for example, ethylthio, 2-carboxyethylthio, dodecylthio, 1-carboxydodecylthio, phenylthio, 2-butoxy-5-t-octylphenylthio, and tetrazolylthio), an arylsulfonyl group (for example, 2-butoxy-5-tert-octylphenylsulfonyl), an arylsulfinyl group (for example, 2-butoxy-5-tert-octylphenylsulfinyl), a carbamoylamino group (for example, N-methylcarbamoylamino and N-phenylcarbamoylamino), a 5-membered or 6-membered nitrogen-containing heterocyclic group (for example, imidazolyl, pyrazolyl, triazolyl, tetrazolyl, and, 1,2-dihydro-2-oxo-1-pyridyl), an imide group (for example, succinimide and hydantoinyl), and an arylazo group (for example, phenylazo and 4-methoxyphenylazo). These groups may further be naturally substituted with the substitutents enumerated for $R_4$. There is available as a splitting group bonded via a carbon atom, a bis type coupler which can be obtained by condensing a tetra-equivalent coupler with aldehydes and ketones. The splitting group according to the present invention may contain the photographically useful groups such as a development inhibitor and a development accelerator.

X is preferably a halogen atom, an alkoxy group, an aryloxy group, an alkyl- or arylthio group, an arylsulfonyl group, an arylsulfinyl group, or a 5-membered or 6-membered nitrogen-containing heterocyclic group bonded to a coupling active site via the nitrogen atom. X is more preferably an arylthio group.

In the cyan coupler represented by Formula (Ia), the group represented by $R_1$, $R_2$, $R_3$, $R_4$ or X may contain the cyan coupler residue represented by Formula (Ia) to form a dimer or a higher polymer, or the group represented by $R_1$, $R_2$, $R_3$, $R_4$ or X may bond to a high-molecular chain to form a homopolymer or a copolymer. The homopolymer or copolymer containing the high molecular chain is an addition polymer having the cyan coupler residue represented by Formula (Ia), and the typical example thereof is a homopolymer or copolymer of an ethylene type unsaturated compound. In this case, one or more kinds of a cyan color development repetitive unit having the cyan coupler residue represented by Formula (Ia) may be contained in the polymer and one or more kinds of a non-color developable ethylene type monomer such as acrylic acid ester, methacrylic acid ester, and maleic acid ester, which is not subjected to a coupling with the oxidation product of an aromatic primary amine developing agent, may be contained in the polymer as a copolymerization component.

Specific examples of the coupler of the present invention are shown below but the present invention is not limited thereto.

(1)
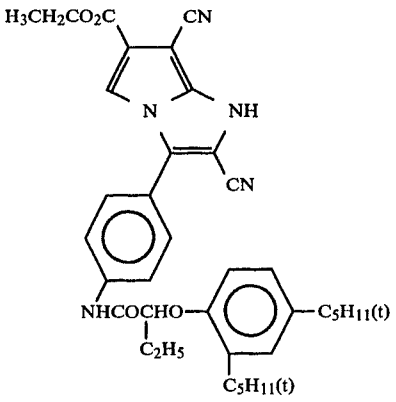
(2)
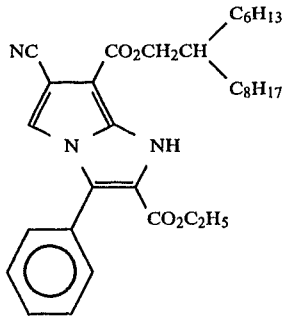

-continued
(3)
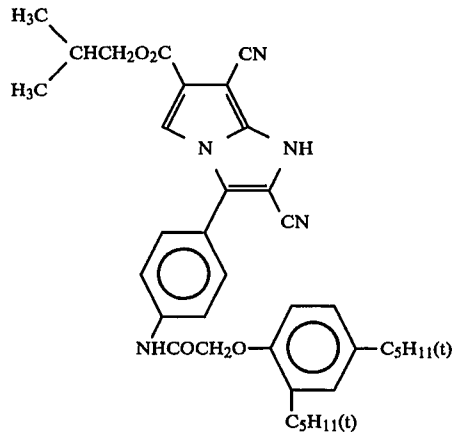
(4)
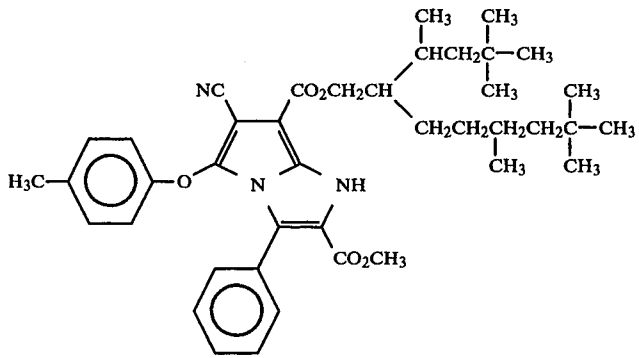

-continued
(5)
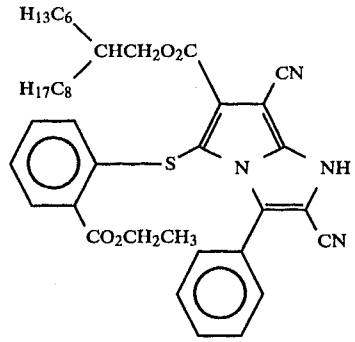
(6)
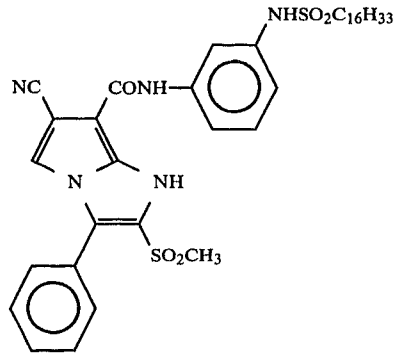
(7)
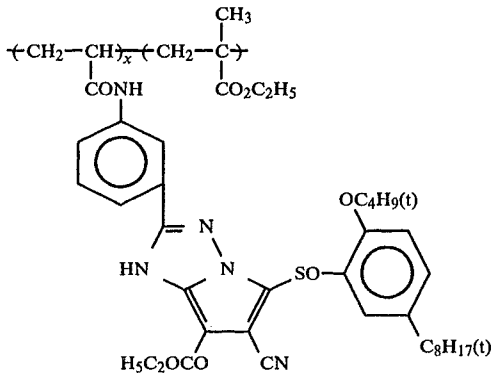
X:Y = 50:50 (mol ratio)

-continued
| No. | $R_1$ | $R_2$ | $R_4$ | X |
|---|---|---|---|---|
| | | | 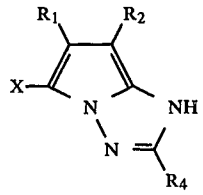 | |
| 8 | $CO_2CH_3$ | CN | 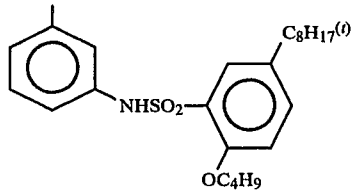 | H |
| 9 | CN | 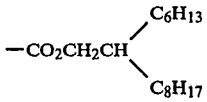 | 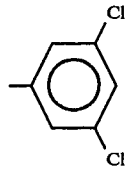 | H |
| 10 | CN | 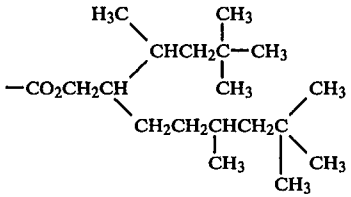 | 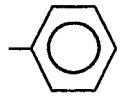 | H |
| 11 | CN | 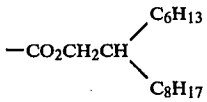 | 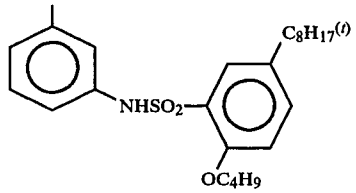 | H |

-continued
| | | | | |
|---|---|---|---|---|
| 12 | CN | 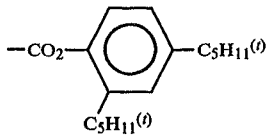 | 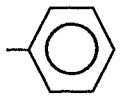 | H |
| 13 | CN | 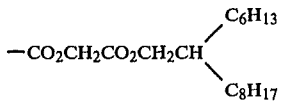 | 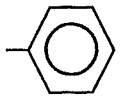 | H |
| 14 | CN | $-CO_2CH_2CH_2(CF_2)_6F$ | 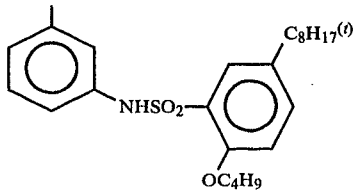 | H |
| 15 | CN | 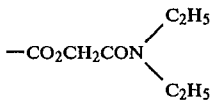 | 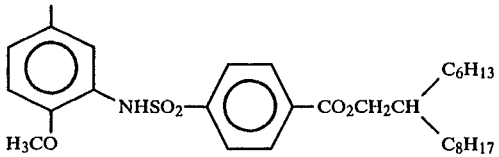 | 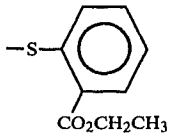 |
| 16 | CN | $-CO_2CH_2CH_2(CF_2)_6F$ | 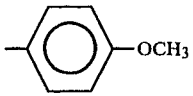 | 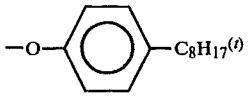 |
| 17 | CN | 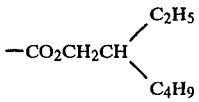 | 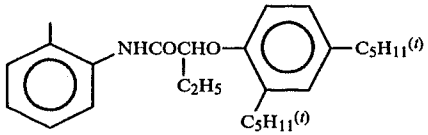 | 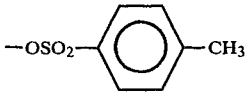 |

-continued
| | | | | |
|---|---|---|---|---|
| 18 | CN | 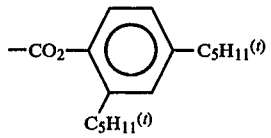 | 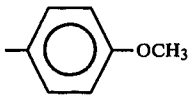 | 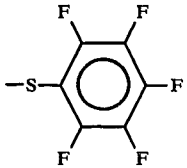 |
| 19 | CN | 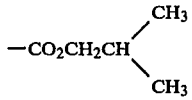 | 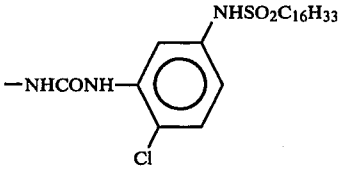 | 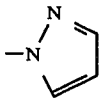 |
| 20 | CN | $-CO_2CH_2(CF_2)_4H$ | 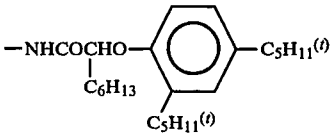 | 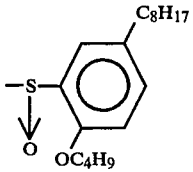 |
| 21 | CN | 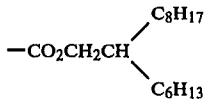 | 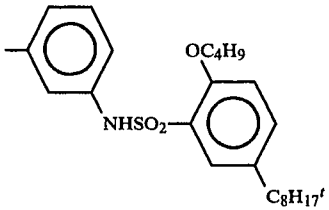 | H |
| 22 | 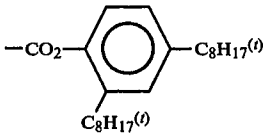 | CN | 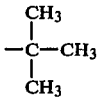 | 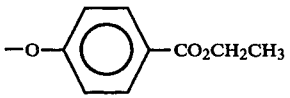 |
| 23 | $-CO_2CH_2C_6F_{13}$ | CN | 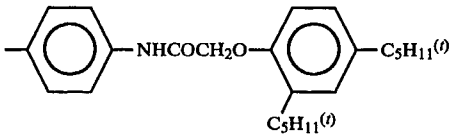 | Cl |

-continued
| | | | | |
|---|---|---|---|---|
| 24 | 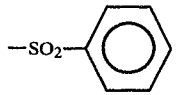 | 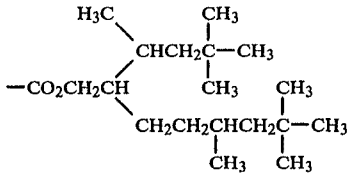 | $CH_3$ | $-OCOCH_3$ |
| 25 | CN | $-CO_2CH_2CO_2CH_3$ | 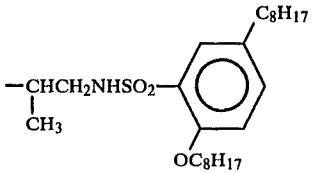 | 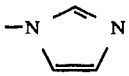 |
| 26 | CN | 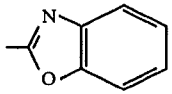 | 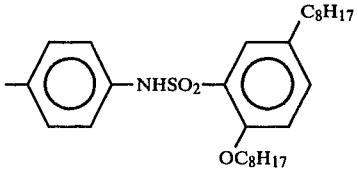 | 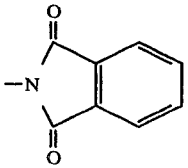 |
| 27 | CN | $CF_3$ | 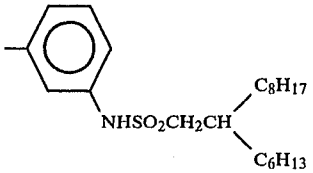 | Cl |
| 28 | 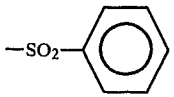 | $CF_3$ | 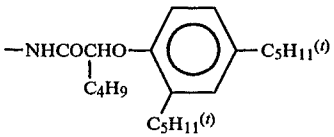 | F |
| 29 | CN | 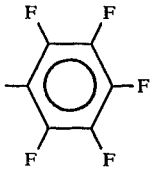 | 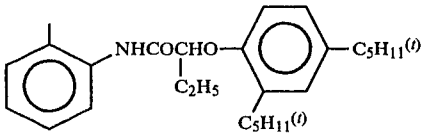 | 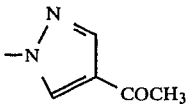 |

-continued
| | | | | |
|---|---|---|---|---|
| 30 | 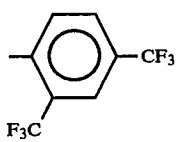 | 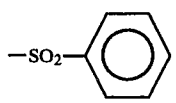 | 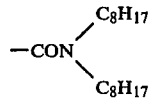 | 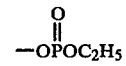 |
| 31 | CN | 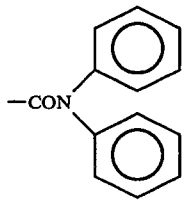 | 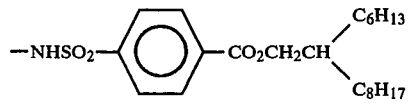 | 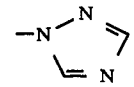 |
| 32 | CN | 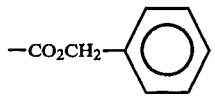 | 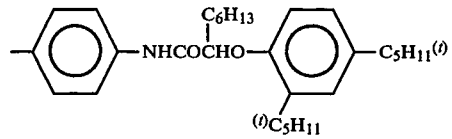 | H |
| 33 | CN | 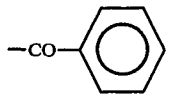 | 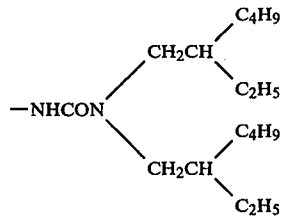 | $-OSO_2CH_3$ |
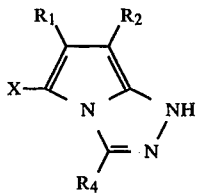

-continued
| | | | | |
|---|---|---|---|---|
| 34 | $-CO_2C_2H_5$ | CN | 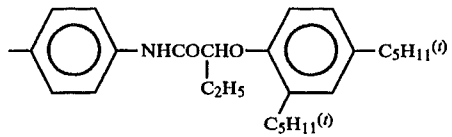 | Cl |
| 35 | CN | 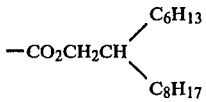 | 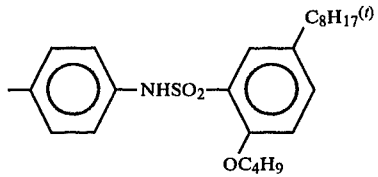 | H |
| 36 | CN | $-CO_2CH_2CH_2(CF_2)_6F$ | 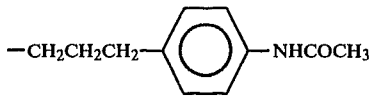 | 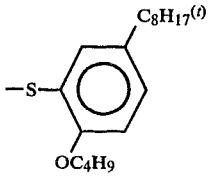 |
| 37 | CN | 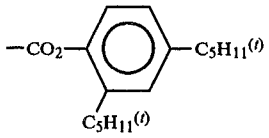 | 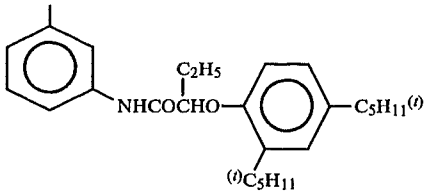 | 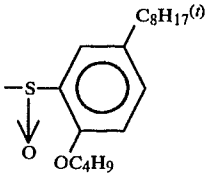 |
| 38 | CN | 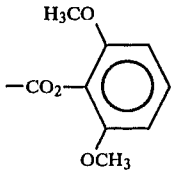 | 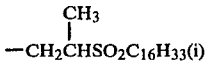 | 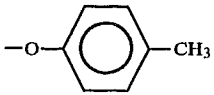 |

-continued
| | | | | |
|---|---|---|---|---|
| 39 | CN | 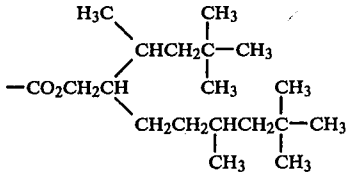 | 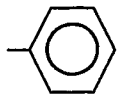 | H |
| 40 | CN | 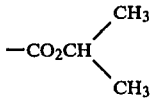 | 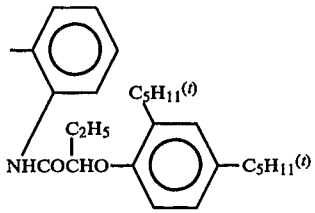 | Cl |
| 41 | CN | 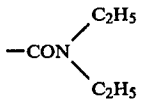 | 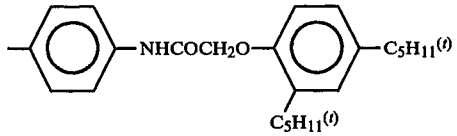 | $-OSO_2CH_3$ |
(42)
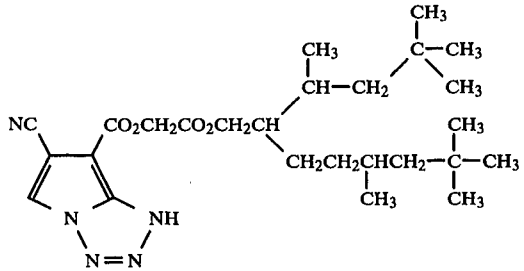
(43)
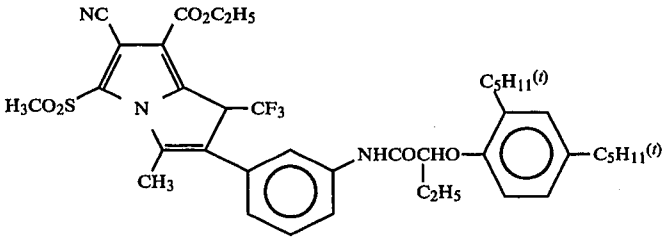

-continued
(44)
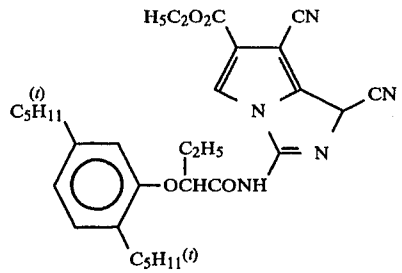
(45)
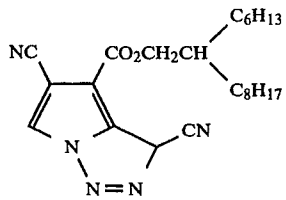
(46)
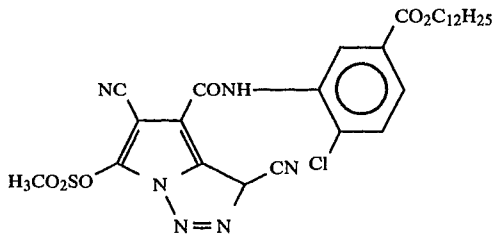

The compound and intermediate product thereof can be synthesized by the publicly known methods. They can be synthesized according to the methods described in, for example, *J. Am. Chem. Soc.*, No. 80, 5332 (1958), *J. Am. Chem. Soc.*, No. 81, 2452 (1959), *J. Am. Chem. Soc.*, No. 112, 2465 (1990), *Org. Synth.*, I, 270 (1941), *J. Chem. Soc.*, 5149 (1962), *Heterocycles*, No. 27, 2301 (1988), and *Rec. Trav. Chim.*, 80, 1075 (1961), the publications cited therein, or the methods equivalent thereto.

Synthetic Example 1

Synthesis of the Exemplified Compound (9)

The exemplified compound (9) was synthesized via the following route:

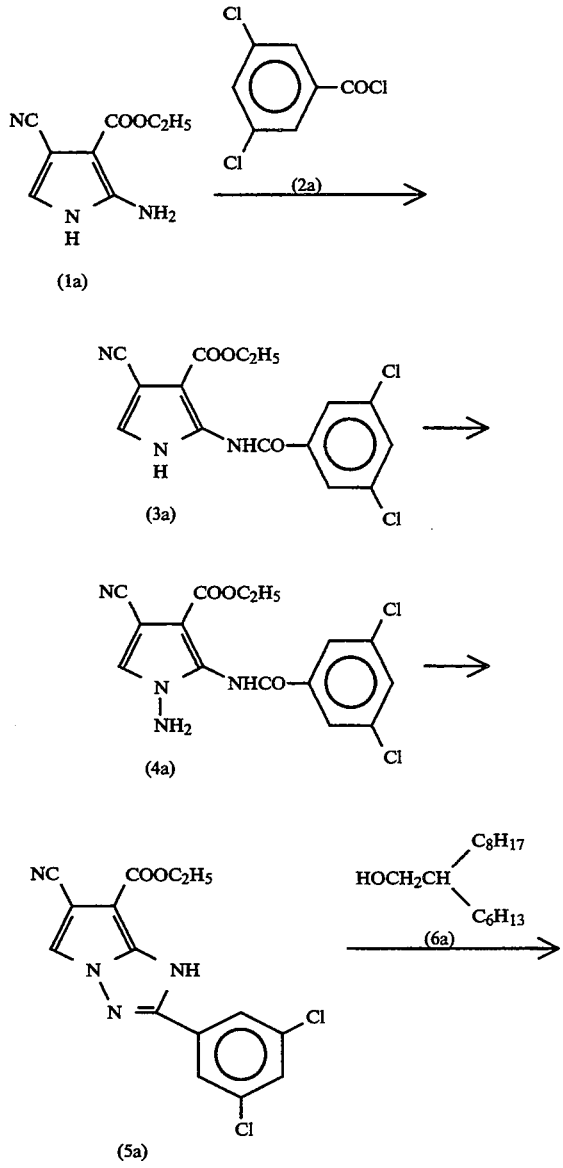

-continued

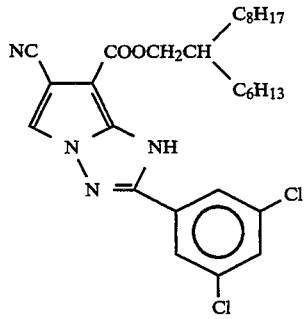

Exemplary Coupler (9)

Added to the dimethylacetamide (300 ml) solution of 2-amino-4-cyano-3-ethoxycarbonylpyrrole (1a) (66.0 g, 0.4 mole) was 3,5-dichlorobenzoyl chloride (2a) (83.2 g, 0.4 mole) at room temperature, and stirring was applied for 30 minutes. Water was added and the solution was extracted with ethyl acetate twice. An organic phase was collected and washed with water and a saturated aqueous salt solution, followed by drying with anhydrous sodium sulfate. The solvent was distilled off under a reduced pressure and the residue was recrystallized from acetonitrile (300 ml), whereby the compound (3a) (113 g, 84%) was obtained.

The powder of potassium hydroxide (252 g, 4.5 mole) was added to the dimethylformamide (200 ml) solution of the compound (3a) (101.1 g, 0.3 mole) at room temperature and stirred well. While cooling with water, hydroxylamine-o-sulfonic acid (237 g, 2.1 mole) was added dropwise, taking care that the temperature did not suddenly rise, and after completing the addition, the solution was stirred for 30 minutes. A 0.1N hydrochloric acid aqueous solution was added dropwise to neutralize the solution which was tested with a pH test paper. The solution was extracted with ethyl acetate three times. An organic phase was washed with water and a saturated aqueous salt solution and then dried with anhydrous sodium sulfate. The solvent was distilled off under a reduced pressure and the residue was refined by column chromatography (a spreading solvent, hexane:ethyl acetate=2:1), whereby the compound (4a) (9.50 g, 9%) was obtained.

Carbon tetrachloride (9 ml) was added to the acetonitrile (30 ml) solution of the compound (4a) (7.04 g, 20 mmole) at room temperature and subsequently triphenyl phosphine (5.76 g, 22 mmole) was added, followed by heating and refluxing for 8 hours. After cooling down, water was added and the solution was extracted with ethyl acetate three times. An organic phase was washed with water and a saturated aqueous salt solution and then dried with anhydrous sodium sulfate. The solvent was distilled off under a reduced pressure and the residue was refined with silica gel column chromatography (a spreading solvent, hexane:ethyl acetate=4:1), whereby the compound (5a) (1.13 g, 17%) was obtained.

The compound (5a) thus obtained 1.8 g and the compound (6a) 12.4 g were dissolved in sulfolane 2.0 ml and further titanium isopropoxide 1.5 g was added thereto. The reaction was carried out for 1.5 hours while maintaining the reaction temperature at 110° C. and then ethyl acetate was added, followed by washing with water. After the ethyl acetate phase was dried, the solvent was distilled off and the residue was refined by column chromatography, whereby the desired exemplified compound (9) 1.6 g was obtained. The melting point thereof was 97° to 98° C.

When the cyan coupler of the present invention is applied to a silver halide color light-sensitive material, it may have at least one layer containing the coupler of the present invention on a support. The layer containing the coupler of the present invention may be a hydrophilic layer provided on the support. In general, the color light-sensitive material can be of the constitution in which a blue-sensitive silver halide emulsion layer, a green-sensitive silver halide emulsion layer, and a red-sensitive silver halide emulsion layer are coated, in this order, on a support, but the order may be different from this. Further, at least one of the above light-sensitive emulsion layers can be replaced with an infrared-sensitive silver halide emulsion layer. The silver halide emulsions having sensitivities in the respective wavelength regions and the couplers forming the dyes having the relationship of a complementary color with the rays to which the emulsions are sensitive can be contained in these light-sensitive emulsions to carry out a color reproduction by a subtractive color process. Also, there may be used a constitution in which the light-sensitive emulsion layers have no such relationship as mentioned above, with the hues of the dyes formed by the couplers.

When the coupler of the present invention applied to the light-sensitive material, it is used particularly preferably for a red-sensitive silver halide emulsion layer.

The addition amount of the coupler of the present invention to a light-sensitive material is usually $1\times10^{-3}$ to 1 mole, preferably $2\times10^{-3}$ to $5\times10^{-1}$ mole per mole of silver halide.

The preferred coating amount of the cyan coupler of the present invention is $2.0\times10^{-6}$ to $2.0\times10^{-3}$ mole, further preferably $2.0\times10^{-5}$ to $1.0\times10^{-3}$ mole per $m^2$ of the light-sensitive material. The cyan coupler of the present invention can be used by arbitrarily mixing the inventive cyan coupler with other known couplers, but the use proportion of the cyan coupler of the present invention is preferably 5 mole % or more, further preferably 30 mole % or more.

Silver halide grains which are contained in the light-sensitive emulsion layer together with the pyrroloazole-type cyan couplers of the present invention are (a) silver bromochloride grains having a silver chloride content of 90 mole % or more or silver chloride grains, each being chemically sensitized with a gold compound (hereafter "the first embodiment") or (b) silver bromochloride grains containing substantially no silver iodide and having a silver chloride content of 90 mole % or more and a silver bromide-rich phase on the grain surface or in the inside thereof having a silver bromide content larger by 5 mole % or more than those at the other portions (hereafter "the second embodiment").

Hereafter, the first embodiment is described in detail below.

In the halogen composition of the silver halide grains according to the first embodiment of the present invention, the silver chloride content is required to be 90 mole % or more. Further, it comprises preferably silver bromochloride in which 95 mole % or more of the silver halides constituting the silver halide grains is composed of silver chloride and which contains substantially no silver iodide, or silver chloride, wherein "contains substantially no silver iodide" means the silver iodide of 1.0 mole % or less. The more preferred halogen composition of the silver halide grains is of silver bromochloride in which 98 mole % or more of the silver halides constituting the silver halide grains is composed of silver chloride and which contains substantially no silver iodide, or silver chloride. The silver bromochloride content of the total silver halides constituting the grain, which is reduced to less than 90 mole %, is not preferred since the developing speed gets slow. Meanwhile, sufficient sensitivity can not be obtained with pure silver chloride containing no silver bromide at all and therefore it is not preferred as well.

The silver halide grains of the first embodiment preferably have a localization phase having the silver bromide content exceeding at least 10 mole %. Such localization phase (hereinafter referred to as a silver bromide-localized phase) having the silver bromide content higher than that of a substrate is desired to be present in the vicinity of the grain surface in order to demonstrate marked effects of the present invention and further, from the viewpoints of a pressure performance and a processing solution composition dependency. The term "vicinity of the grain surface" used therein means the area present within 1/5 of the grain size of the silver halide grain used, which is measured from the outermost surface thereof. It is present preferably within 1/10 of the grain size of the silver halide grain used, which is measured from the outermost surface thereof. In the most preferred disposition of the silver bromide-localized phase, the localization phase having the silver bromide content exceeding at least 10 mole % is epitaxially grown at the corner site of the cubic or tetradecahedral silver chloride grain.

The silver bromide content in such the silver bromide-localized phase preferably exceeds 10 mole %, but too high a silver bromide content sometimes provides characteristics unfavorable for the photographic light-sensitive material, such that a desensitization is caused when a pressure is exerted to the light-sensitive material. Sensitivity and a gradation may be changed to a large extent due to changes in the composition of processing solutions. Taking these matters into consideration, the silver bromide content in the silver bromide-localized phase resides preferably in the range of 10 to 60 mole %, more preferably 20 to 50 mole %.

The silver bromide-localized phase consists preferably of 0.1 to 20%, more preferably 0.5 to 7% of silver, based on the silver amount constituting the silver halide grains and coexisting with the cyan coupler of the present invention.

The interface between the silver bromide-localized phase and the other phases in the grain may have a distinct phase boundary or a transit area in which the halogen composition gradually changes.

Such the silver bromide-localized phase can be formed with various methods. For example, a soluble silver salt and a soluble halide can be reacted by a single mixing method or a simultaneous mixing method to form the localization phase. Further, the localization phase can be formed with a conversion method in which the silver halide grains already formed are converted to silver halide grains having a lower solubility product. The silver bromide-localized phase can be formed by, for example, adding a water-soluble bromide aqueous solution to the cubic or tetradecahedral silver halide host grains, or mixing the above silver halide host grains with the silver bromochloride or silver bromide fine grains having a smaller average grain size and higher silver bromide content than those of the silver halide host grains and then ripening it.

The silver bromide-localized phase is formed preferably under the presence of an iridium compound. "The silver bromide-localized phase is formed under the presence of the iridium compound" described herein means to supply the iridium compound simultaneously with, immediately before or immediately after the supply of silver or halide for forming the localization phase. For example, where the silver bromide-localized phase is formed by adding a water-soluble bromide aqueous solution, the iridium compound is preferably added to the aqueous solution in advance, or another solution containing the iridium compound is preferably added at the same time. Where the silver bromide-localized phase is formed by mixing the silver halide fine grains having a higher silver bromide content and then ripening it, the iridium compound is preferably incorporated in advance into the silver halide fine grains having the higher silver bromide content. The iridium compound may be allowed to be present in forming the phases other than the silver bromide-localized phase, wherein the silver bromide-localized phase is preferably formed together with at least 50%, more preferably at least 80% of the whole amount of the iridium compound added.

The silver halide grains according to the present invention may have a (100) face, a (111) face, or both of the faces, or may contain a higher order face. Cubes or tetradecahedrons consisting primarily of the (100) face are preferred.

The size of the silver halide grains according to the present invention is arbitrary as long as it falls within the conventional range. Preferred is the case that the average grain size thereof is 0.1 to 1.5 μm. The grain size distribution thereof may be of a monodispersion or polydispersion, and the monodispersion is preferred. In a grain size distribution representing the degree of the monodispersion, the ratio (s/d) of a statistical standard deviation (s) to an average grain size (d) is preferably 0.2 or less, more preferably 0.15 or less. Two or more kinds of the monodispersed emulsions are preferably mixed and used.

The silver halide emulsion containing the cyan coupler of the present invention is required to be chemically sensitized with a gold compound. The gold compound to be used may be of a gold oxidation number of 1 or 3 and various gold compounds can be used. There can be enumerated as the representative example thereof, hydrogen tetrachloraurate (III), hydrogen tetracyanoaurate (III), hydrogen tetrakis(thiocyanate) aurate (III) or the alkali metal salt thereof, bis(thiosulfate) aurate (I), and a complex ion or complex salt of dimethylrhodanateaurate(I) chloride.

The addition amount of these gold compounds is generally in the range of $1\times10^{-8}$ to $1\times10^{-2}$ mole, preferably $1\times10^{-7}$ to $1\times10^{-3}$ mole, and more preferably $1\times10^{-6}$ to $1\times10^{-4}$ mole per mole of silver halide.

These gold compounds are added in the preparation of a silver halide emulsion, preferably until finishing a chemical sensitization.

At least one of the mercapto compounds shown in JP-A-3-233448 can be added to the silver halide emulsion used in the first embodiment to prevent the increase in a fog, particularly the increase in the fog in using a gold sensitizer to a markedly large extent. With respect to the timing of such an addition, they may be added at a grain forming step, a desalting step, or a chemical ripening step, or immediately before coating. They are added preferably at the grain forming step, desalting step or chemical ripening step, particularly before adding the gold sensitizer.

The addition amount of the mercapto compounds is preferably $1\times10^{-6}$ to $5\times10^{-2}$ mole, more preferably $1\times10^{-4}$to $1\times10^{-2}$ mole per mole of silver halide. An addition portion is not specifically limited and may be either in a light-sensitive layer or a non-light-sensitive layer. Further, an adding method is not specifically limited as well and may be during either of a silver halide grain formation, a physical ripening, a chemical ripening,.and the preparation of a coating solution.

The second embodiment of the present invention is now described in detail below.

Similarly to those used in the first embodiment, the silver halide grains contained in the light-sensitive silver halide emulsion layer containing the cyan dye-forming coupler consist of the silver bromochloride grains containing substantially no silver iodide and having the silver chloride content of 90 mole % or more, preferably 95 to 99.9 mole %. The silver bromochloride content of the total silver halides constituting the grain, which is reduced to less than 90 mole %, is not preferred since the developing speed gets slow. Meanwhile, sufficient sensitivity cannot be obtained with pure silver chloride containing no silver bromide at all and therefore it is not preferred in the second embodiment. The grains "containing substantially no silver iodide" mean the grains having the silver iodide content of 1.0 mole % or less, preferably containing no silver iodid. The values of the above halogen compositions show the average values. The "average value" is the value obtained by averaging the values of the halogen compositions of the whole grains contained in one kind of the silver halide emulstion used in the present invention.

The silver halide grains of the second embodiment have a silver bromide-rich phase on the surface or inside of the grain in the constitution of a continuous and uniform layer, or has the silver bromide-rich phase in an uneven and discontinuous or isolated form. The silver bromide content in the silver bromide-rich phase is substantially different from those at the other portions of the grain, and the value thereof is 5% or more.

The silver halide emulsion contained in this cyan color developing layer contains 50% or more, more preferably 70% or more and most preferably 90% or more by weight of the high silver chloride grains provided with the silver bromide-rich phase as described above.

As generally well-known, the processes for preparing the silver halide emulsion according to the second embodiment comprise a silver halide grain-forming process in which a water soluble silver salt and a water soluble halide are reacted, a desalting process and a chemical ripening process. The silver bromide-rich phase according to the second embodiment can be provided at the above silver halide grain-forming process, desalting process and chemical ripening process. To be specific, there are available the method in which a water soluble halide solution is added dividing into several times while changing the halogen composition in the water soluble halide solution, the method in which a bromide ion-supplying compound is added during or after the grain formation to carry out a halogen conversion, and further the method in which the high silver bromide fine grains are added to precipitate a silver bromide-rich phase on the grains. The provision of the silver bromide-rich phase by a halogen conversion or the addition of the high silver bromide fine grains is carried out preferably before a chemical sensitization process.

Group VIII metals and/or the complex ions of the other polyvalent metal ions such as $IrCl_6$ are preferably contained in the silver bromide-rich phase according to the second embodiment.

Where the silver bromide-rich phase is provided by halogen conversion or addition of the fine grains, the degree of the difference between the silver bromide contents of the substrate (the parts other than the silver bromide-rich phase in the silver halide grain) and the silver bromide-rich phase is determined by the mole ratio used of a silver bromide fine grain and a scarcely soluble bromide to a host silver halide grain, the speed of supplying a water soluble bromide to the host silver halide emulsion, and pAg and pH of the reaction solution. That is, the silver bromide-rich phase is formed, for example, by adding a silver nitrate solution and a halogen ion to the host silver halide emulsion at a prescribed speed while controlling pAg and pH. Further, it can be formed as well by adding the scarcely soluble bromide such as a silver bromide fine grain and a silver bromochloride fine grain to carry out a physical ripening, or it can also be formed by substituting the host silver bromochloride with a bromine ion. The uneven and discontinuous or isolated silver bromide-rich phase in the second embodiment is formed preferably by adding a water soluble bromide and a water soluble silver nitrate or adding the silver bromide fine grains to carry out the physical ripening using the so-called CR-compounds described in, for example, JP-A-61-311131, JP-A-62-86252, JP-A-62-86163, JP-A-62-86165, JP-A-62-70005, and JP-A-62-152330.

The silver bromide content in the silver bromide-rich phase, as well as that in the silver bromide-localized phase of the first embodiment, can be measured with an X ray diffraction method (described in, for example, "New Experimental Chemical Course 6, Structural Analysis" edited by Japan Chemical Society, published by Maruzen) or an XPS method (described in, for example, Surface Analysis; "Application of IMA, Auger Electron and Photoelectron Spectrometry", published by Kohdansha), and the silver bromide content in the phase present particularly at an edge and a corner in an uneven or isolated state can be measured with an EDX method (described in, for example, "Electron Beam Micro-analysis" written by K. Soejima, published by Daily Industry News Paper Co.).

It is necessary that the silver bromide-rich phase has a silver bromide content higher by 5 mole % or more than those in the silver halides adjacent thereto. The silver bromide content in the silver bromide-rich phase preferably exceeds 10 mole %. A too-high silver bromide content sometimes causes unfavorable characteristics such as desensitization when a pressure is applied to the light-sensitive material. In view of this problem, the silver bromide content in the silver bromide-rich phase is preferably in the range of 10 to 60 mole %, most preferably 20 to 50 mole %.

The silver bromide-rich phase is preferably composed of 0.1 to 5 mole % silver, more preferably 0.2 to 4 mole % silver based on the total silver constituting the silver halide grains according to the second embodiment.

In the silver bromide-rich phase in the silver halide grain according to this embodiment, the silver bromide-rich phase containing at least 10 mole % of silver bromide based on the total silver bromide contained in the silver bromide-rich phases is epitaxially grown preferably in the vicinity of a grain peak. The "vicinity of the peak" represents the inside of the square in which one side thereof corresponds to $\frac{1}{3}$, more preferably 1/5 of the diameter of the circle having the same area as that of the projected cube or corresponding-to-cube regular crystal silver bromochloride grain and the peak of the grain (the intersecting point of the sides of the regular crystal grain which is cube or assumed to be cube) is one of the corners thereof.

In the second embodiment, a sulfur sensitizer is preferably used during the chemical ripening process. To be specific, there are enumerated the well-known unstable sulfur compounds such as thiosulfate (for example, hypo), thioureas (for example, diphenyl thiourea, triethyl thiourea and allyl thiourea), and rhodanines. They can be used in the amount of $10^{-7}$ to $10^{-2}$ mole per mole of silver halide.

Noble metal sensitizers such as gold, platinum, palladium, and iridium are also preferably used in combination or singly. In particular, a gold sensitizer is used preferably in combination with the sulfur sensitizer. To be concrete, there are enumerated chlorauric acid, potassium chloraurate, potassium aurithiocyanate, gold sulfide, and gold selenide. They can be used in the amount of $10^{-7}$ to $10^{-2}$ mole per mole of silver halide.

Further, a selenium sensitizer and a tellurium sensitizer are preferably used as well in combination.

The unstable selenium sensitizers described in, for example, JP-B-44-15748 (the term "JP-B" as used herein means an examined Japanese patent publication) can be preferably used.

To be concrete, there are enumerated the compounds such as colloidal selenium, selenoureas (for example, N,N-dimethyl selenourea, selenourea and tetramethyl selenourea), selenoamides (for example, selenoacetoamide and N,N-dimethylselenobenzamide), selenoketones (for example, selenoacetone and selenobenzophenone), selenides (for example, triphenyl phosphine selenide and diethyl selenide), selenophosphates (for example, tri-p-tolylselenophosphate), selenocarboxylic acids and esters thereof, and isoselenocyanates. They can be used in the amount of $10^{-8}$ to $10^{-3}$ mole per mole of silver halide.

Further, in the second embodiment, a reduction sensitizer is preferably used as well. To be concrete, there are enumerated stannous chloride, aminoiminomethanesulfinic acid, a hydrazine derivative, a borane compound (for example, diethylamine borane), a silane compound, and a polyamine compound.

The chemical sensitization is preferably carried out as well in the presence of a silver halide solvent.

To be concrete, there are enumerated thiocyanate (for example, potassium thiocyanate), a thioether compound (the compounds described in, for example, U.S. Pat. Nos. 3,021,215 and 3,271,157, JP-B-58-30571, and JP-A-60-136736, in particular, for example, 3,6-dithia-1,8-octanediol), a tetra-substituted thiourea compound (described in, for example, JP-B-59-11892, and U.S. Pat. No. 4,221,863, in particular, for example, tetramethyl thiourea), the thione compounds described in JP-B-60-11341, the mercapto compounds described in JP-B-63-29727, the mesoionic compounds described in JP-A-60-163042, the selenoether compounds described in U.S. Pat. No. 4,782,013, the telluroether compounds described in JP-A-2-118566, and sulfites. Of them, particularly preferably used are thiocyanate, the thioether compounds, the tetra-substituted thiourea compounds, and the thione compounds. They can be used in the amount of $10^{-5}$ to $10^{-2}$ mole per mole of silver halide.

The silver halide grains according to the second embodiment may have a (100) face, a (111) face, or both of the faces, or may contain a higher order face. Cube or tetradecahedron consisting primarily of the (100) face is preferred.

The size of the silver halide grains is arbitrary as long as it falls within the range usually used. Preferred is the case that the average grain size thereof is 0.1 to 1.5 nun. The grain size distribution thereof may be of a monodispersion or polydispersion, and the monodispersion is preferred. In the grain size distribution representing the degree of the monodispersion, the ratio (s/d) of a satistical standard deviation (s) to an average grain size (d) is preferably 0.2 or less, more preferably 0.15 or less.

For the purpose of obtaining a broader latitude, two or more kinds of the above monodispersed emulsions are preferably mixed and used for the same layer, or simultaneously coated.

Additionally, there can be preferably used as well an emulsion in which the tabular grains having an average aspect ratio (circle area-corresponding diameter/thickness) of 5 or more, preferably 8 or more, account for 50% or more of total grains. The emulsion used in the second embodiment can be synthesized by the methods described in *Chemie et Phisique Photographique* written by P. Glafkides (published by Paul Montel Co., Ltd., 1967), *Photographic Emulsion Chemistry* written by G. F. Duffin (published by Focal Press Co., Ltd., 1966), and *Making and Coating Photographic Emulsion* written by V. L. Zelikman, (published by Focal Press Co., Ltd., 1964). That is, there may be used any of an acid method, a neutral method and an ammonia method. Any of a single jet method, a double jet method and the combination thereof may be used as the method for allowing a water soluble silver salt to react with a water soluble halide. There can be used as well the method in which the grains are formed under the presence of excessive silver ions (a so-called reverse mixing method). There can be used as one form of the double jet method, the method in which pAg of the solution in which the sliver halide grains are formed is maintained constant, that is, a so-called controlled double jet method. With this method a silver halide emulsion having a regular crystal form and an almost uniform grain size can be obtained.

Various polyvalent metal ion impurities can be introduced into the silver halide emulsion of the second embodiment for the purposes of improving a sensitivity, a temperature and humidity dependency in exposing, and a latent image preservability in the course of an emulsion grain formation and a physical ripening. There can be given as the examples of the compounds to be used, the salts of cadmium, zinc, lead, copper, and thallium, and the salts or complex salts of iron, ruthenium, rhodium, palladium, osmium, iridium, and platinum, which are the elements of the Group VIII. In particular, the above Group VIII elements can be preferably used. The addition amount of these compounds is over a broad range according to the desired purpose and is preferably $10^{-9}$ to $10^{-2}$ mole per mole of silver halide.

The silver halide emulsion used in the present invention (including both the first and second embodiments) is subjected to a spectral sensitization as well as a chemical sensitization.

The spectral sensitization is carried out for the purpose of providing the emulsions contained in the respective layers of the light-sensitive material of the present invention with the spectral sensitivities in the prescribed wavelength regions. In the present invention, there can be preferably added for spectral sensitization, a dye absorbing rays in the wavelength region corresponding to the desired spectral sensitivity-spectral sensitizing dye. There can be given as the spectral sensitizing dye used for the above purpose, the compounds described in, for example, *Heterocyclic Compounds-Cyanine Dyes and Related Compounds* written by F. M. Harmer (published by John Wiley & Sons, New York, London, 1964). Those described at the right upper column of the page 22 to the page 38 of JP-A-62-215272 are preferably used as the specific examples of the compound and the spectral sensitizing method.

Various compounds or precursors thereof can be incorporated into the silver halide emulsions used in the present invention for the purposes of preventing fog generated at the preparing step, during storage or during the processing of a light-sensitive material, or stabilizing the photographic performance. The compounds described at the pages 39 to 72 of above JP-A-62-215272 can be used as the specific examples of these compounds.

The emulsion used in the present invention may be either a so-called surface latent image-type emulsion in which a latent image is formed mainly on a grain surface or a so-called inner latent image type emulsion in which the latent image is formed mainly in the inside of the grain.

In the present invention, the content of calcium atoms contained in the photographic constitutional layer consisting of the silver halide emulsion layers and non-light-sensitive hydrophilic layers (a protective layer, an intermediate layer and a subbing layer) is reduced to 15 $mg/m^2$ or less to allow the effects of the present invention to be more markedly demonstrated. The calcium content is more preferably 1 to 10 $mg/m^2$, most preferably 2 to 8 $mg/m^2$. The calcium content (the amount converted to a calcium atom, the same will be applied hereinafter) depends primarily on the calcium content in the gelatin used as a binder in a silver halide photographic light-sensitive material. In particular, if gelatin which is not subjected to a treatment for removing calcium is used, 16 $mg/m^2$ or more of calcium will usually be contained in the silver halide light-sensitive material.

In the present invention, any gelatin may be used as long as the calcium content thereof is 15 $mg/m^2$ or less. To be specific, preferred is the silver halide light-sensitive material prepared by using partially or entirely gelatin with the reduced calcium content, which is obtained by subjecting gelatin once or several times to processing with an ion exchange resin or a dialysis processing.

For the purpose of improving the sharpness of an image, there are preferably incorporated into a hydrophilic colloid layer of the light-sensitive material according to the present invention so that the optical reflection density of the light-sensitive material in 680 nm becomes 0.70 or more, the dyes (among them, an oxonol series dye) capable of being decolored by processing, described at pages 27 to 76 of European Patent EP 0,337,490A2, and into an anti-water resin layer of a support, titanium oxide which is subjected to a surface treatment with di- to tetrahydric alcohols (for example, trimethylolethane) in the proportion of 12% by weight or more (more preferably 14% by weight or more).

With respect to an organic high boiling solvent for the photographic additives, capable of being used in the present invention, such as the cyan, magenta and yellow couplers, any ones can be used as long as they are the compounds which have a melting point of 100° C. or less and a boiling point of 140° C. or more and which are immiscible with water and are the good solvents for the couplers. The organic high boiling solvent has preferably a melting point of 80° C. or less. It has preferably a boiling point of 160° C. or more, more preferably 170° C. or more.

The details of these organic high boiling solvents are described at the right lower column of the page 137 to the right upper column of the page 144 in JP-A-62-215272.

The cyan, magenta and yellow couplers can be impregnated in a loadable latex polymer (for example, U.S. Pat. No. 4,203,716) or dissolved together with a water insoluble and organic solvent soluble polymer under the presence or absence of the above organic high boiling solvent to be emulsified and dispersed in a hydrophilic colloid aqueous solution.

Preferably used are the homopolymers or copolymers described at the 7th to 15th columns of U.S. Pat. No. 4,857,449 and at the pages of 12 to 30 of International Publication WO88/00723. A methacrylate series or acrylamide series polymer, particularly an acrylamide series polymer is preferably used in terms of the stabilization of a dye image.

Also, in the light-sensitive material according to the present invention, the color image preservability-improving compounds described in European Patent EP 0,277,589A2 are preferably used together with a coupler. In particular, they are used preferably in combination with a pyrazoloazole coupler and a pyrroloazole coupler.

That is, preferably used simultaneously or singularly for preventing side effects of, for example, the generation of stain due to the reaction of a color developing agent or the oxidation product thereof remaining in a layer during a storage after processing with a coupler are the compounds (F) which are chemically combined with an aromatic amine type developing agent remaining after a color development processing to form a chemically inactive and substantially colorless compound, and/or the compounds (G) which are chemically combined with the oxidation product of an aromatic amine type developing agent remaining after a color development processing to form a chemically inactive and substantially colorless compound.

Further, the anti-mold agents described in JP-A-63-271247 are preferably added to the light-sensitive material according to the present invention for the purpose of preventing various molds and bacteria which grow in a hydrophilic colloid layer to deteriorate an image.

There may be used as a support used for the light-sensitive material according to the present invention, for display, a white color polyester series support or a support in which a layer containing a white pigment is provided on a support side having a silver halide emulsion layer. An anti-halation layer is preferably provided on a support side coated thereon with a silver halide emulsion layer or the backside thereof in order to further improve a sharpness. In particular, the transmission density of a support is controlled preferably in the range of 0.35 to 0.8 so that a display can be admired with either a reflected light or a transmitted light.

The light-sensitive material according to the present invention may be exposed with either a visible ray or an infrared ray. An exposing manner may be either a low illuminance exposure or a high illuminance and short time exposure. Particularly preferred for the present invention is an exposing system in which an exposing time per a picture element is shorter than $10^{-3}$ second and more preferred is a laser scanning exposing system in which an exposing time per a picture element is shorter than $10^{-4}$ second.

In exposure, a band stop filter described in U.S. Pat. No. 4,880,726 is preferably used, whereby a light mixture is removed to notably improve a color reproduction.

An exposed light-sensitive material can be subjected to a conventional color development processing and for the purpose of a rapid processing, it is preferably subjected to a bleach-fixing processing after the color development. Particularly where the aforementioned high silver chloride emulsion is used, pH of the bleach-fixing solution is preferably 6.5 or less, more preferably about 6 or less for the purpose of accelerating desilver.

Those described in the following patent publications, particularly European Patent EP 0,355,660A2(JP-A-2-139544) are preferably used as the silver halide emulsions, other materials (the additives) and photographic constitutional layers (a layer arrangement) applied to the light-sensitive material according to the present invention, and the processing methods and additives for processing, which are applied for processing this light-sensitive material:

| Photographic elements | JP-A-62-215272 | JP-A-2-33144 | EP 0355660A2 |
|---|---|---|---|
| Silver halide emulsion | p. 10, right upper column, line 6 to p. 12, left lower column, line 5, and p. 12, right lower column, line 4 from bottom to p. 13, left upper column, line 17. | p. 28, right upper column, line 16 to p. 29, right lower column, line 11, and p. 30, lines 2 to 5. | p. 45, line 53 to p. 47, line 3, and p. 47, line 20 to 22. |
| Silver halide solvent | p. 12, left lower column, line 6 to 14, and p. 13, left upper column, line 3 from bottom to p, 18, left lower column, last line. | — | — |
| Chemical sensitizer | p. 12, left lower column, line 3 from bottom to right lower column, line 5 from bottom, and p. 18, right lower column, line 1 to p. 22, right upper | p. 29, right lower column, line 12 to last line. | p. 47, lines 4 to 9. |

-continued

| Photographic elements | JP-A-62-215272 | JP-A-2-33144 | EP 0355660A2 |
|---|---|---|---|
| | column, line 9 from bottom. | | |
| Spectral sensitizer (spectral sensitizing method) | p. 22, right upper column, line 8 from bottom to p. 38, last line. | p. 30, left upper column, lines 1 to 13. | p. 47, lines 10 to 15. |
| Emulsion stabilizer | p. 39, left upper column, line 1 to p. 72, right upper column, last line. | p. 30, left upper column, line 14 to right upper column, line 1. | p. 47, lines 16 to 19. |
| Development accelerator | p. 72, left lower column, line 1 to p. 91, right upper column, line 3. | — | — |
| Color coupler (cyan, magenta and yellow couplers) | p! 91, right upper column, line 4 to p. 121, left upper column, line 6. | p. 3, right upper column, line 14 to p. 18, left upper column, last line, and p. 30, right upper column, line 6 to p. 35 right lower column, line 11. | p. 4, lines 15 to 27, p. 5, line 30 to p. 28, last line, p. 45, lines 29—31, and p. 47, line 23 to p. 63, line 50. |
| Color forming accelerator | p. 121, left upper column, line 7 to p. 125, right upper column, line 1. | — | — |
| UV absorber | p. 125, right upper column, line 2 to p. 127, left lower column, last line. | p. 37, right lower column, line 14 to p. 38, left upper column,line ii. | p. 65, lines 22 to 31. |
| Anti-fading agent (an image stabilizer) | p. 127, right lower column, line 1 to p. 137, left lower column, line 8. | p. 36, right upper column, line 12 to p. 37, left upper column, line 19. | p. 4, line 30 to p. 5, line 23, p. 29, line 1 to p. 45, line 25, p. 45, line 33 to 40, and p. 65, lines 2 to 21. |
| High boiling and/or low boiling organic solvent | p. 137, left lower column, line 9 to p. 144, right upper, last line. | p. 35, right lower column, line 14 to p. 36, left upper, line 4. | P. 64, lines 1 to 51. |
| Method for dispersing photographic additives | p. 144, left lower column, line 1 to p. 146, right upper column, line 7. | p. 27, right lower column, line 10 to p. 28, left upper, last line, and p. 35, right lower column, line 12 to p. 36, right upper column, line 7. | P. 63, line 51 te P. 64, line 56. |
| Hardener | p. 146, right upper column, line 8 to p. 155, left lower column, line 4. | — | — |
| Precursor of a developing agent | p. 155, left lower column, line 5 to right lower column, line 2. | — | — |
| Development inhibitor-releasing compound | p. 155, right lower column, lines 3 to 9. | — | — |
| Support | p. 155, right lower column, line 19 to p. 156, left upper column, line 14, | p. 38, right upper column, line 18 to p. 39, left upper column, line 3. | p. 66, line 29 to p. 67 line 13. |
| Light-sensitive layer structure | p. 156, left upper column, line 15 to right lower column, line 14. | p. 28, right upper column, line 1 to 15. | p. 45, lines 41 to 52. |
| Dye | p. 156, right lower column, line 15 to p. 184, right lower column, last line. | p. 38, left upper column, ine 12 t right upper column, li? ne 7. | p. 66, lines 18 to 22. |
| Anti-color mixing agent | p. 185, left upper column, line 1 to p. 188, right lower column, line 3. | p. 36, right upper column, line 8 to 11, | p. 64, line 57 to p. 65 line 1. |
| Gradation controller | p. 188, right lower column, line 4 to 8. | — | — |
| Anti-stain agent | p. 188, right lower column, line 9 to p. 193, right lower column, line 10. | p. 37, left upper column, last line to right lower column, line 13. | p. 65, line 32 to p. 66, line 17. |
| Surface active agent | p. 201, left lower column, line 1 to p. 210, right upper column, last line. | p. 18, right upper column, line 1 to p. 24, right lower column, last line, and p. 27, left lower column, line 10 from bottom to right lower column, line 9. | — |
| Fluorinated compound (anti-electrification agent, coating aid, lubricant and | p. 210, left lower column, line 1 to p. 222, left lower column, line 5. | p. 25, left upper column, line 1 to p. 27, right lower column, line 9. | |

-continued

| Photographic elements | JP-A-62-215272 | JP-A-2-33144 | EP 0355660A2 |
|---|---|---|---|
| anti-adhesion agent) | | | |
| Binder (hydrophilic colloid) | p. 222, left lower column, line 6 to p. 225, left upper column, last line. | p. 38, right upper column, line 8 to 18. | p. 66, lines 23 to 28. |
| Thickener | p. 225, right upper column, line 1 to p. 227, right upper column, line 2. | — | — |
| Anti-electrification agent | p. 227, right upper column, line 3 to p, 230, left upper column, line 1. | — | — |
| Polymer latex | p. 230, left upper column, line 2 to p. 239, last line | — | — |
| Matting agent | p. 240, left upper column, line 1 to right upper column, last line. | — | — |
| Photographic processing method (processing steps and additives) | p. 3, right upper column, line 7 to p. 10, right upper column, line 5. | p. 39, left upper column, line 4 to p. 42, left upper column, last line. | p. 67, line 14 to p. 69, line 28. |

Remarks:
1. There is included in the cited items of JP-A-62-215272, the content amended according to the Amendment of March 16, 1987.
2. Of the above color couplers, preferably used are the yellow coupler are the so-called short wave type couplers described in JP-A-63-231451, JP-A-63-123047, JP-A-63-241547, JP-A-1-173499, JP-A-1-213648, and JP-A-1-250944. Further, there can be preferably used the cycloalkane type acetanilide series yellow couplers described described in EP 0,482,552.

There may be used as a cyan coupler, the cyan couplers of the present invention in combination with a phenol series cyan coupler, the diphenylimidazole series cyan couplers described in JP-A-2-33144, the 3-hydroxypyridine series cyan couplers described in European Patent EP 0,333,185A2 (of them, particularly preferred are the coupler prepared by providing the tetraequivalent coupler (42) exemplified as the specific example with a chlorine splitting group to convert it to a divalent coupler, and the couplers (6) and (9)), and the cyclic active methylene series cyan couplers (of them, particularly preferred are the couplers 3, 8 and 34 which are exemplified as the specific example) described in JP-A-64-32260.

The method described in a left upper column at page 27 to a right upper column at page 34 of JP-A-2-207250 can be preferably applied as the method for processing a silver halide color light-sensitive material in which a high silver chloride emulsion having a silver chloride content of 90 mole % or more is used.

EXAMPLES

The present invention will be explained below with reference to the examples but not limited thereto.

EXAMPLE 1

Lime-treated gelatin 32 g was added to distilled water 800 ml and dissolved at 40° C. Then, sodium chloride 5.8 g and N,N'-dimethylimidazolidine-2-thione (a 1% aqueous solution) 1.0 ml were added and the temperature was raised to 53° C. Subsequently, the solution prepared by dissolving silver nitrate 80 g in distilled water 480 ml and the solution prepared by adding sodium chloride 27.6 g in distilled water 480 ml were added and mixed with the above solution over the period of 60 minutes while maintaining the temperature at 53° C. Next, a solution prepared by dissolving silver nitrate 80 g in distilled water 300 ml and a solution prepared by adding sodium chloride 24.3 g and potassium hexacyanoferrate (III) trihydrate 4 mg in distilled water 300 ml were added and mixed over the period of 20 minutes while maintaining the temperature at 53° C. The emulsion was subjected to a desalting and a rinsing at 40° C. Then, lime-treated gelatin 90 g was added and further pAg and pH were adjusted to 7.4 and 6.4, respectively, with sodium chloride and sodium hydroxide. After the temperature was raised to 58° C., potassium bromide 0.45 g was added to form a silver bromide-localized phase on an emulsion grain surface and further an optimum sulfur sensitization was provided with triethyl thiourea. Then, the following red-sensitive sensitizing dye of $3\times10^{-4}$ mole per mole of silver halide was added to subject the emulsion to a spectral sensitization. The silver bromochloride emulsion thus obtained was designated as Emulsion $R_1$.

Emulsion $R_2$ was prepared in the same manner as that in Emulsion $R_1$ except that the single sulfur sensitization with triethyl thiourea was replaced with a gold sulfur sensitization with triethyl thiourea and chlorauric acid of $5\times10^{-6}$ mole per mole of silver halide.

Emulsion $R_3$ was prepared in the same manner as that in Emulsion $R_1$ except that the sulfur sensitization with triethyl thiourea was replaced with a gold sensitization with chlorauric acid of $2\times10^{-5}$ mole per mole of silver halide.

The reaction temperature was changed to prepare the emulsions with the desired grain sizes and a blue-sensitive sensitizing dye and a green-sensitive sensitizing dye were added in place of the red-sensitive sensitizing dye, whereby Emulsions B1, B2, G1 and G2 were prepared.

A paper support laminated on the both sides thereof with polyethylene, which was subjected to a corona discharge treatment, was provided with a gelatin subbing layer containing sodium dodecylbenzenesulfonate, and further was coated with the various photographic constitutional layers, whereby the multilayered color photographic paper (Sample 101) having the following layer constitution was prepared. The coating solutions were prepared in the following manner.

Preparation of the Fifth Layer Coating Solution

There were added and dissolved the cyan coupler (ExC) 35.0 g, sodium dodecylbenzenesulfonate 14.0 g, ethyl acetate 100 ml, the UV absorber (UV-2) 19.0 g, the dye image stabilizer (Cpd-8) 1.1 g, the dye image stabilizer (Cpd-9) 1.1 g, the dye image stabilizer (Cpd-10) 1.1 g, the dye image stabilizer (Cpd-11) 1.1 g, the dye image stabilizer (Cpd-12) 1.1 g, the solvent (Solv-1) 1.1 g and the solvent (Solv-6) 23.3 g. This solution was emulsified and dispersed in a 10% gelatin aqueous solution with a high speed stirring emulsifier, whereby the emulsified dispersion A was prepared.

The above emulsified dispersion A and this silver bromochloride emulsion $R_1$ were mixed and dissolved, whereby the fifth layer coating solution was prepared so that it was of the following composition.

The coating solutions for the first layer to seventh layer were prepared in the same manner as that in the fifth layer coating solution. Sodium 1-oxy-3,5-dichloro-s-triazine was used as the hardener for the respective layers.

Further, Cpd-15 and Cpd-16 were added to the respective layers so that the whole amounts thereof became 25.0 mg/m$^2$ and 50.0 mg/m$^2$, respectively.

The following spectral sensitizing dyes were used for the silver bromochloride emulsions contained in the respective light-sensitive emulsion layers:

Blue-sensitive Emulsion Layer

Sensitizing dye A

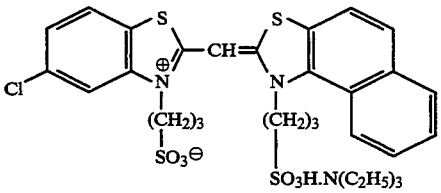

and

Sensitizing dye B

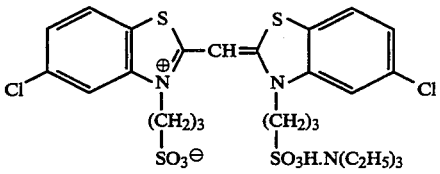

(each $2.0\times10^{-4}$ mole per mole of silver halide to the large size emulsion and each $2.5\times10^{-4}$ mole per mole of silver halide to the small size emulsion).

Green-sensitive Emulsion Layer

Sensitizing dye C

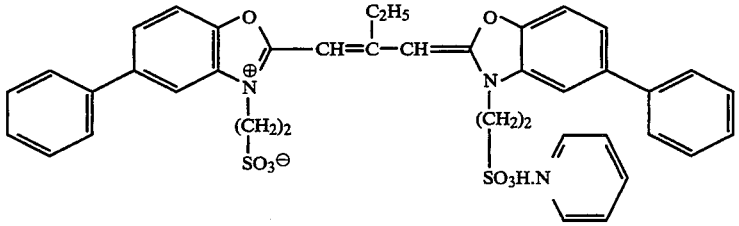

($4.0\times10^{-4}$ mole per mole of silver halide to the large size emulsion and $5.6\times10^{-4}$ mole per mole of silver halide to the small size emulsion)

Sensitizing dye D

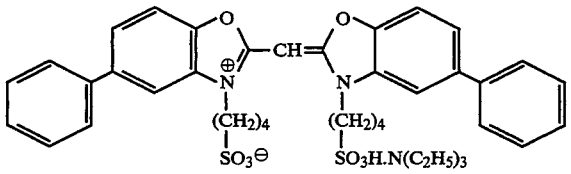

($7.0\times10^{-5}$ mole per mole of silver halide to the large size emulsion and $1.0\times10^{-4}$ mole per mole of silver halide to the small size emulsion).

Red-sensitive Emulsion Layer

Sensitizing dye E

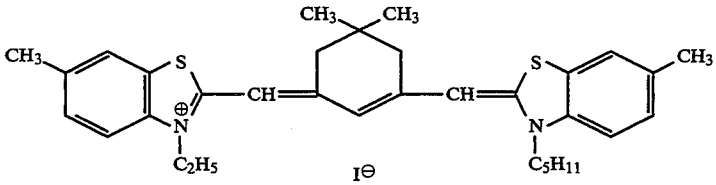

($0.9\times10^{-4}$ mole per mole of silver halide).

Further, the following compound was added in the amount of $2.6\times10^{-3}$ mole per mole of silver halide:

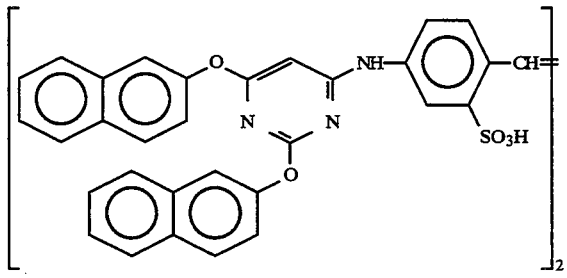

Further, 1-(5-methylureidophenyl)-5-mercaptotetrazole was added to the blue-sensitive emulsion layer, green-sensitive emulsion layer and red-sensitive emulsion layer in the amounts of $3.4\times10^{-4}$ mole, $9.7\times10^{-4}$ mole and $5.5\times10^{-4}$ mole per mole of silver halide, respectively.

Further, 4-hydroxy-6-methyl-1,3,3a,7-tetraazaindene was added to the blue-sensitive emulsion layer and green-sensitive emulsion layer in the amounts of $1\times10^{-4}$ mole and $2\times10^{-4}$ mole per mole of silver halide, respectively.

Further, the following dye (the numeral in the patenthesis represents a coated amount) was added to the emulsion layers to prevent an irradiation:

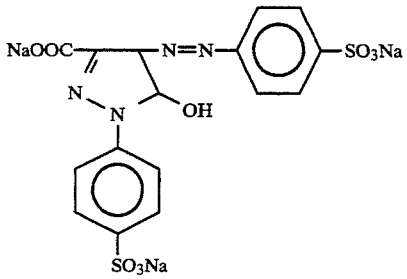

(10 mg/m²)

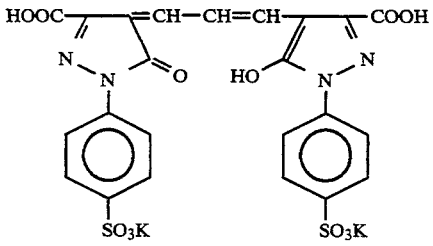

(10 mg/m²)

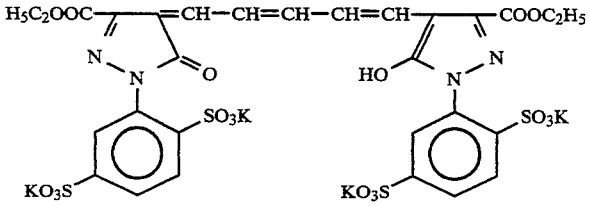

(40 mg/m²)

and

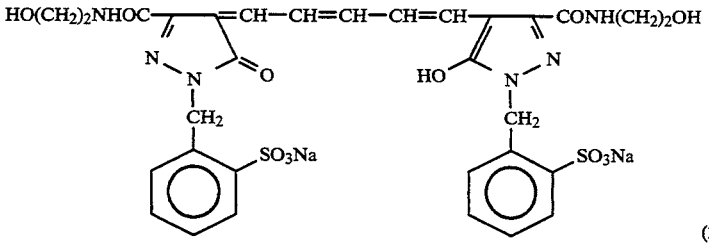

(20 mg/m²)

Layer Constitution

The compositions of the respective layers are shown below. The numerals represent the coated amounts (g/m²). The coated amounts of the silver halide emulsions are expressed in terms of the amounts converted to silver.

Support:

Polyethylene laminated paper (a center surface average roughness SRa=0.12 μm) [polyethylene coated on the 1st layer side contains a white pigment (containing titanium oxide 14 weight %) and a blue dye (ultramarine)].

| | |
|---|---|
| First layer (a blue-sensitive emulsion layer): | |
| Silver bromochloride emulsion (cube, 5:5 mixture (Ag mole ratio) of the large size emulsion B1 having the average grain size of 0.80 μm and the small size emulsion B2 having the average grain size of 0.65 μm, wherein the fluctuation coefficients in the grain size distributions were 0.08 and 0.09, respectively, and either size emulsions comprised the grains in which silver bromide 0.4 mol% was localized on a part of the grain surface and the rest was silver chloride) | 0.27 |
| Gelatin | 1.36 |
| Yellow coupler (ExY) | 0.79 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |
| Second layer (an anti-color mixing layer): | |
| Gelatin | 0.99 |
| Anti-color mixing agent (Cpd-4) | 0.08 |
| Solvent (Solv-2) | 0.25 |
| Solvent (Solv-3) | 0.25 |
| Third layer (a green-sensitive emulsion layer): | |
| Silver bromochloride emulsion (cube, 6:4 mixture (Ag mole ratio) of the large size emulsion G1 having the average grain size of 0.55 μm and the small size emulsion G2 having the average grain size of 0.39 μm, wherein the fluctuation coefficients in the grain size distributions were 0.10 and 0.08, respectively, and either size emulsions comprised the grains in which silver bromide 0.8 mol % was localized on a part of the grain surface and the rest was silver chloride) | 0.13 |
| Gelatin | 1.45 |

-continued

| | |
|---|---|
| Magenta coupler (ExM) | 0.16 |
| Dye image stabilizer (Cpd-6) | 0.15 |
| Dye image stabilizer (Cpd-2) | 0.03 |
| Dye image stabilizer (Cpd-7) | 0.01 |
| Dye image stabilizer (Cpd-8) | 0.01 |
| Dye image stabilizer (Cpd-9) | 0.08 |
| Solvent (Solv-3) | 0.50 |
| Solvent (Solv-4) | 0.15 |
| Solvent (Solv-5) | 0.15 |
| Fourth layer (an anti-color mixing layer): | |
| Gelatin | 0.70 |
| Anti-color mixing agent (Cpd-4) | 0.04 |
| Dye image stabilizer (Cpd-5) | 0.02 |
| Solvent (Solv-2) | 0.18 |
| Solvent (Solv-3) | 0.18 |
| Fifth layer (a red-sensitive emulsion layer): | |
| Above silver bromochloride emulsion $R_1$ | 0.20 |
| Gelatin | 0.85 |
| Cyan coupler (ExC) | 0.33 |
| UV absorber (UV-2) | 0.18 |

-continued

| | |
|---|---|
| Dye image stabilizer (Cpd-10) | 0.01 |
| Dye image stabilizer (Cpd-11) | 0.01 |
| Dye image stabilizer (Cpd-12) | 0.01 |
| Dye image stabilizer (Cpd-9) | 0.01 |
| Dye image stabilizer (Cpd-8) | 0.01 |
| Solvent (Solv-6) | 0.22 |
| Solvent (Solv-1) | 0.01 |
| Sixth layer (a UV absorbing layer): | |
| Gelatin | 0.55 |
| UV absorber (UV-1) | 0.40 |
| Dye image stabilizer (Cpd-13) | 0.15 |
| Dye image stabilizer (Cpd-6) | 0.02 |
| Seventh layer (a protective layer): | |
| Gelatin | 1.13 |
| Acryl-modified copolymer of polyvinyl alcohol (a modification degree: 17%) | 0.15 |
| Liquid paraffin | 0.03 |
| Dye image stabilizer (Cpd-14) | 0.01 |

The compounds used here are shown below:

(ExY) Yellow coupler
1:1 mixture (mole ratio) of

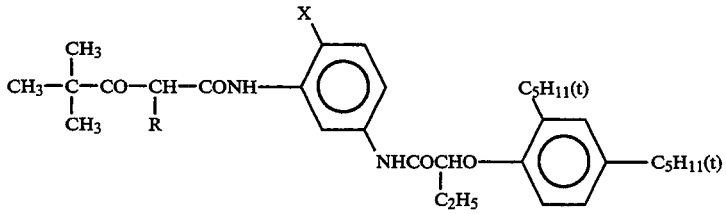

R =

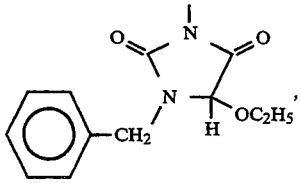

, X = Cl and

R =

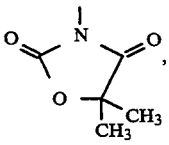

, X = $OCH_3$ (ExM) Magenta coupler

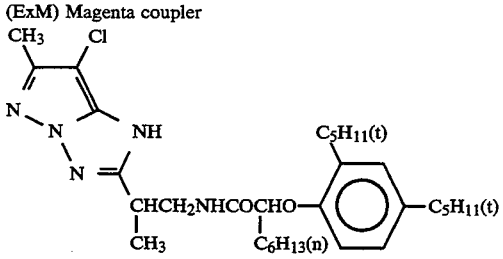

(ExC) Cyan coupler

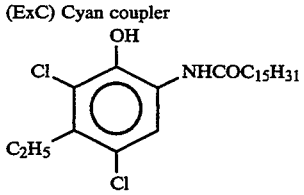

(Cpd-1) Dye image stabilizer

-continued
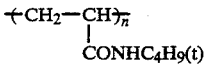
(Average molecular weight: 60,000)
(Cpd-2) Dye image stabilzer
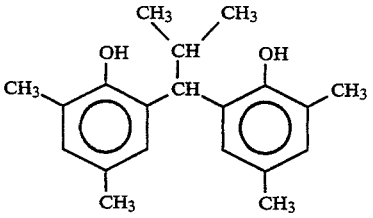
(Cpd-3) Dye image stablilzer
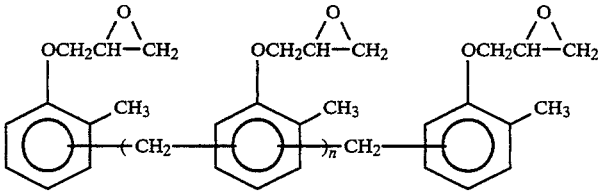
n = 7 to 8 (average value)
(Cpd-4) Anti-color mixing agent
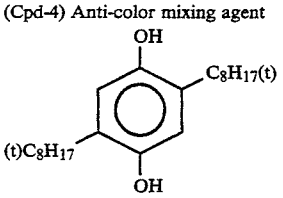
(Cpd-5) Dye image stabilizer
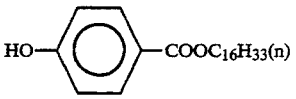
(Cpd-6) Dye image stabilizer
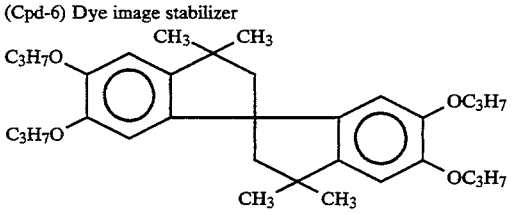
(Cpd-7) Dye image stabilizer
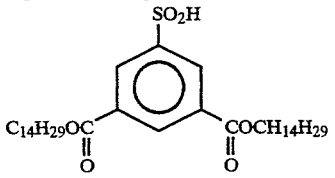
(Cpd-8) Dye image stabilizer
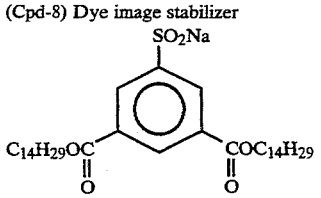
(Cpd-9) Dye image stabilizer -continued
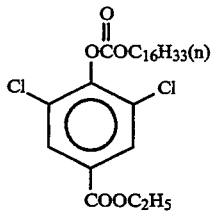
(Cpd-10) Dye image stabilizer
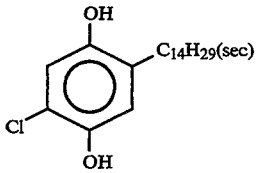
(Cpd-11) Dye image stabilizer
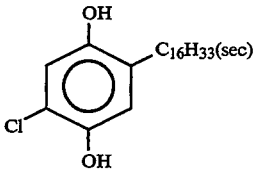
(Cpd-12) Dye image stabilizer
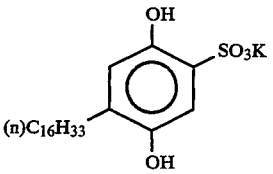
(Cpd-13) Dye image stabilizer
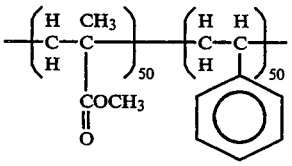
Average molecular weight: about 60,000
(Cpd-14) Dye image stabilizer
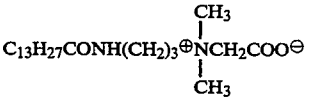
Preservative (Cpd-15)
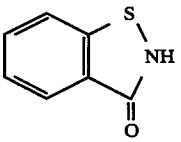
Preservative (Cpd-16)
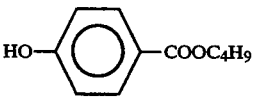
UV absorber (UV-1)
1:5:10:5 mixture (weight ratio) of (i), (ii), (iii) and (iv)

-continued
(i)
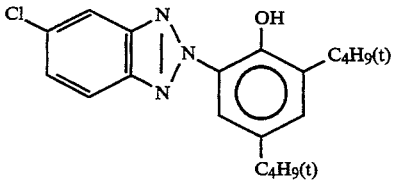
(ii)
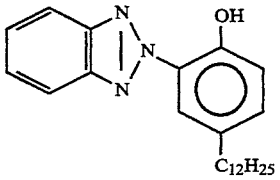
(iii)
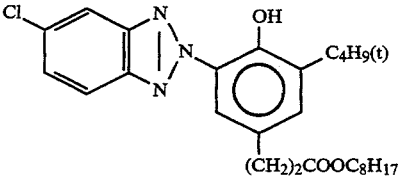
(iv)
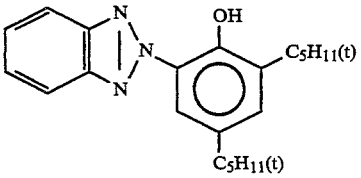
(UV-2) UV absorber
1:2:2 mixture (weight ratio of) (i), (ii) and (iii) Solvent
(v)
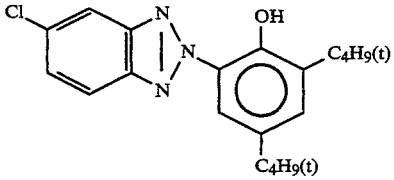
(vi)
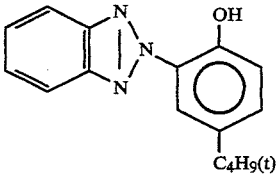
(vii)
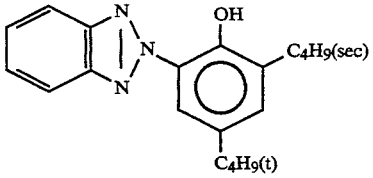
(Solv-1) Solvent
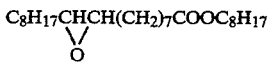
(Solv-2) Solvent
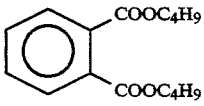

-continued (Solv-3) Solvent

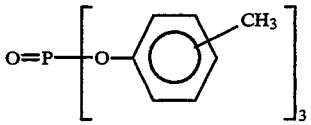

(Solv-4) Solvent

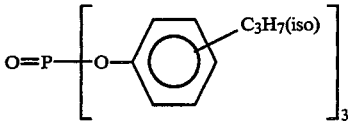

(Solv-5) Solvent

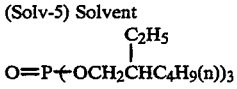

(Solv-6) Solvent

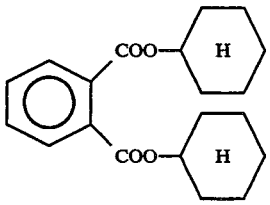

In order to maintain the surface layer constant, gelatin contained in the respective layers was added so that the ratio thereof to an oil soluble component was kept fixed.

Based on the light-sensitive material thus obtained, the light-sensitive materials were prepared in the same manner as above except that the emulsion and cyan coupler contained in the red-sensitive emulsion layer were replaced as shown in Table 1. These samples were designated as Samples 101 to 118, provided that the coated amounts of the emulsion and cyan coupler in the fifth layer (the red-sensitive emulsion layer) in the samples in which the cyan couplers (10) and (11) were used were set at 0.17 g/m$^2$ and 0.16 g/m$^2$, respectively.

The coated amounts of the emulsion and cyan coupler in the fifth layer (the red-sensitive emulsion layer) in the samples in which the cyan coupler (20) was used were set at 0.12 g/m$^2$ and 0.16 g/m$^2$, respectively.

Samples 113 to 115 were prepared in the same manner as that in Samples 107 to 109 except that the yellow coupler (ExY) contained in the first layers (the blue-sensitive emulsion layer) in Samples 107 to 109 was replaced with the same mole of the yellow coupler (ExY-2) and that the coated amount including that of the coupler in the first layer was reduced to 80% by weight without changing the composition thereof.

Similarly, Samples 116 to 118 were prepared in the same manner as that in Samples 110 to 112 except that the yellow coupler contained in the first layer in Samples 110 to 112 was replaced with the same mole of the yellow coupler (ExY-3) and that the coated amount including that of the coupler in the first layer was reduced to 70% by weight without changing the composition thereof.

(ExY-2) Yellow coupler

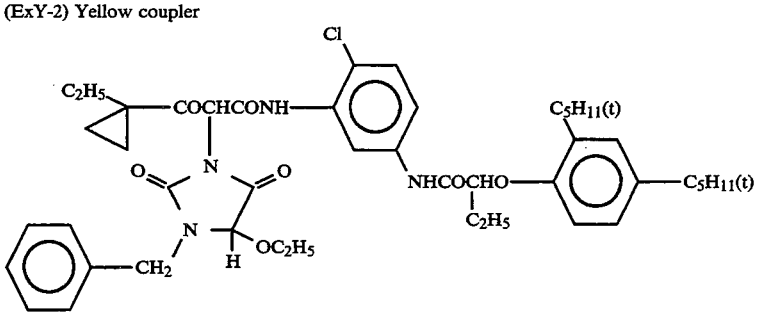

and (ExY-3) Yellow coupler

-continued

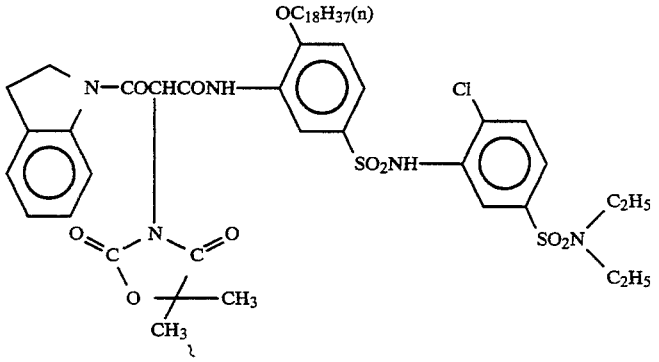

In order to check the sensitivity change and gradation change corresponding to the degree of the mixing of a bleach-fixing solution into a developing solution, 18 kinds of the light-sensitive materials thus obtained were subjected to an exposure via an optical wedge and a red color filter and then to a color development processing at the following steps in the following processing solutions.

Development Processing

The samples which were subjected to the exposure were subjected to the color development with a paper processing machine at the following processing steps.

The prescribed amount of the bleach-fixing solution was separately added to the developing solution.

| Processing step | Temperature | Time |
|---|---|---|
| Color developing | 35° C. | 45 seconds |
| Bleach-fixing | 30 to 35° C. | 45 seconds |
| Rinsing I | 30 to 35° C. | 20 seconds |
| Rinsing J | 30 to 35° C. | 20 seconds |
| Rinsing K | 30 to 35° C. | 20 seconds |
| Drying | 70 to 80° C. | 60 seconds |

(The rinsing was of a three tanks countercurrent system from Rinsing K to Rinsing I)

The compositions of the respective processing solutions are as follows:

| | Amount |
|---|---|
| Color developing solution | |
| Water | 800 ml |
| Ethylenediamine-N,N,N',N'-tetra-methylenephosphonic acid | 1.5 g |
| Potassium bromide | 0.015 g |
| Triethanolamine | 8.0 g |
| Sodium chloride | 1.4 g |
| Potassium carbonate | 25 g |
| N-ethyl-N-(β-methanesulfonamidethyl)-3-methyl-4-aminoaniline sulfate | 5.0 g |
| N,N-bis(carboxymethyl) hydrazine | 4.0 g |
| Monosodium N,N-di(sulfoethyl) hydroxylamine | 4.0 g |
| Fluorescent whitening agent (Whitex 4B manufactured by Sumitomo Chem. Ind. Co., Ltd.)) | 1.0 g |
| Water was added to | 1000 ml |
| pH (25° C.) | 10.05 |
| Bleach-fixing solution | |
| Water | 400 ml |
| Ammonium thiosulfate (700 g/liter) | 100 ml |
| Sodium sulfite | 17 g |
| Iron (III) ammonium ethylenediamine-tetracetate | 55 9 |
| Disodium ethylenediaminetetracetate | 5 g |
| Ammonium bromide | 40 g |
| Water was added to | 1000 ml |

-continued

| | Amount |
|---|---|
| pH (25° C.) | 6.0 |
| Rinsing solution | |
| Deionized water (contents of calcium and magnesium: each 3 ppm or less) | |

The degrees of the mixing of the bleach-fixing solution into the developing solution were set at 0 ml/l, 0.2 ml/l and 0.4 ml/l.

The processed samples thus prepared were subjected to the measurement of a reflection density to obtain a characteristic curve. The sensitivity was defined by the reciprocal of the exposure necessary to give the density higher by 0.5 than a fog density and expressed by the value relative to the sensitivity of Sample 101 at the exposure of 1 second (the degree of the mixing of the bleach-fixing solution into the developing solution: 0 ml/l), which was set at 100. The sensitivities at the mixing degrees of 0 ml/l, 0.2 ml/l and 0.4 ml/l were designated as Sa, Sb and Sc. The gradation was defined by the difference between the exposure corresponding to the density higher by 0.5 than that that corresponding to a sensitivity and the exposure corresponding to the sensitivity. The gradations at the mixing degrees of 0 ml/l, 0.2 ml/l and 0.4 ml/l were designated as γa, γb and γc.

Further, an exposure for a Macbeth chart was carried out and the color reproduction of a blue color and a green color was evaluated as well. The results were classified to Δ (inferior), ○ (good) and ◎ (excellent).

The results obtained by the above measurement are shown in Table 2 below.

TABLE 1

| Sample | Cyan coupler | Red-sensitive emulsion layer |
|---|---|---|
| 101 | ExC | $R_1$ |
| 102 | ExC | $R_2$ |
| 103 | ExC | $R_3$ |
| 104 | (10) | $R_1$ |
| 105 | (10) | $R_2$ |
| 106 | (10) | $R_3$ |
| 107 | (11) | $R_1$ |
| 108 | (11) | $R_2$ |
| 109 | (11) | $R_3$ |
| 110 | (20) | $R_1$ |
| 111 | (20) | $R_2$ |
| 112 | (20) | $R_3$ |
| 113 | (11) | $R_1$ |
| 114 | (11) | $R_2$ |
| 115 | (11) | $R_3$ |
| 116 | (20) | $R_1$ |
| 117 | (20) | $R_2$ |

TABLE 1-continued

| Sample | Cyan coupler | Red-sensitive emulsion layer |
|---|---|---|
| 118 | (20) | $R_3$ |

TABLE 2

| Sample | $\Delta S_1$ (Sa–Sb) | $\Delta S_2$ (Sa–Sc) | $\Delta\gamma_1$ ($\gamma$a–$\gamma$b) | $\Delta\gamma_1$ ($\gamma$a–$\gamma$c) | Blue rep.* | Green rep.* |
|---|---|---|---|---|---|---|
| 101 (Comp.) | 0.03 | 0.05 | 0.06 | 0.08 | Δ | Δ |
| 102 (Comp.) | 0.03 | 0.04 | 0.06 | 0.07 | Δ | Δ |
| 103 (Comp.) | 0.03 | 0.05 | 0.07 | 0.08 | Δ | Δ |
| 104 (Comp.) | 0.06 | 0.13 | 0.11 | 0.19 | ◎ | ○ |
| 105 (Inv.) | 0.02 | 0.04 | 0.05 | 0.07 | ◎ | ○ |
| 106 (Inv.) | 0.03 | 0.03 | 0.05 | 0.07 | ◎ | ○ |
| 107 (Comp.) | 0.07 | 0.13 | 0.12 | 0.20 | ◎ | ◎ |
| 108 (Inv.) | 0.02 | 0.03 | 0.03 | 0.06 | ◎ | ◎ |
| 109 (Inv.) | 0.03 | 0.03 | 0.04 | 0.05 | ◎ | ◎ |
| 110 (Comp.) | 0.07 | 0.14 | 0.10 | 0.22 | ◎ | ◎ |
| 111 (Inv.) | 0.02 | 0.03 | 0.04 | 0.05 | ◎ | ◎ |
| 112 (Inv.) | 0.03 | 0.03 | 0.04 | 0.06 | ◎ | ◎ |
| 113 (Comp.) | 0.07 | 0.12 | 0.13 | 0.21 | ◎ | ◎ |
| 114 (Inv.) | 0.02 | 0.04 | 0.03 | 0.06 | ◎ | ◎ |
| 115 (Inv.) | 0.02 | 0.03 | 0.04 | 0.05 | ◎ | ◎ |
| 116 (Comp.) | 0.08 | 0.14 | 0.10 | 0.20 | ◎ | ◎ |
| 117 (Inv.) | 0.02 | 0.03 | 0.04 | 0.05 | ◎ | ◎ |
| 118 (Inv.) | 0.02 | 0.03 | 0.04 | 0.05 | ◎ | ◎ |

*Color reproduction

The effects of the present invention are apparent from the results shown in Table 2. That is, in Samples 101 to 103 in which the conventional coupler was used, the change in the photographic performances against the mixing degrees of the bleach-fixing solution into the developing solution was small but the color reproduction of blue and green was not favorable. In Samples 104 to 118 in which the couplers of the present invention were used, the color reproduction was certainly favorable. However, in Samples 104, 107 110, 113 and 116 in which there was used Emulsion $R_1$ subjected to a single sulfur sensitization for the red-sensitive emulsion, there was involved the problem that the change in the photographic performances against the mixing degrees of the bleach-fixing solution into the developing solution was large. However, the compatibility of the excellent color reproduction with the reduced change in the photographic performances against the mixing degrees of the bleach-fixing solution into the developing solution could be achieved by the combination of the cyan coupler of the present invention and the emulsion subjected to a gold sensitization. Further, it was newly found that the samples having this combination had less change in photographic performances due to the mixing degrees of the bleach-fixing solution into the developing solution than those in the samples in which ExC was used as the cyan coupler.

EXAMPLE 2

Samples 201 to 209 in which the layer constitution in Example 1 was changed as follows were prepared and evaluated in the same manner as that in Example 1, provided that the coated amounts of the emulsion and cyan coupler contained in the fifth layer (the red-sensitive emulsion layer) in the samples in which the cyan couplers (19) and (11) were used were set at 0.17 g/m$^2$ and 0.16 g/m$^2$, respectively.

A paper support laminated on the both sides thereof with polyethylene, which was subjected to a corona discharge treatment, was provided with a gelatin subbing layer containing sodium dodecylbenzenesulfonate, and further was coated with the various photographic constitutional layers, whereby the multilayered color photographic paper (Sample 201) having the following layer constitution was prepared. The coating solutions were prepared in the following manner.

Preparation of the Fifth Layer Coating Solution

There were added and dissolved the cyan coupler (ExC') 35.0 g, sodium dodecylbenzenesulfonate 14.0 g, ethyl acetate 100 ml, the dye image stabilizer (Cpd-1) 43.8 g, the dye image stabilizer (Cpd-9) 3.3 g, the dye image stabilizer (Cpd-18) 2.2 g, the dye image stabilizer (Cpd-19) 19.7 g, the dye image stabilizer (Cpd-20) 5.5 g, and the solvent (Solv-10) 15.3 g. This solution was emulsified and dispersed in a 10% gelatin aqueous solution with a high speed stirring emulsifier, whereby the emulsified dispersion was prepared.

The emulsified dispersion thus obtained and the silver bromochloride emulsion prepared in the manner shown above were mixed and dissolved, whereby the fifth layer coating solution was prepared so that it was of the following composition.

The coating solutions for the first layer to seventh layer were prepared in the same manner as that in the fifth layer coating solution. Sodium 1-oxy-3,5-dichloro-s-triazine was used as the hardener for the respective layers.

Further, Cpd-15 and Cpd-16 were added to the respective layers so that the whole amounts thereof became 25.0 mg/m$^2$ and 50.0 mg/m$^2$, respectively.

The same compounds as those used in Example 1 were used for the silver bromochloride emulsions used in the respective light-sensitive emulsion layers in the same amounts as those used in Example 1 to carry out a spectral sensitization.

The same dye as that used in Example 1 was added to the emulsion layers in the same amount for the prevention of an irradiation.

Layer Constitution

The compositions of the respective layers are shown below. The numerals represent the coated amounts (g/m$^2$). The coated amounts of the silver halide emulsions are expressed in terms of the amounts converted to silver.

Support:

Polyethylene laminated paper (a center surface average roughness SRa = 0.12 μm) [polyethylene coated on the 1st layer side contains a white pigment (containing titanium oxide 14 weight %) and a blue dye (ultramarine)].

First layer (a blue-sensitive yellow color developing layer):

| | |
|---|---|
| Silver bromochloride emulsion (the same as the emulsion in the first layer in Example 1) | 0.30 |
| Gelatin | 1.22 |
| Yellow coupler (ExY) | 0.82 |
| Dye image stabilizer (Cpd-17) | 0.19 |
| Solvent (Solv-8) | 0.18 |
| Solvent (Solv-1) | 0.18 |

-continued

| | |
|---|---|
| Dye image stabilizer (Cpd-1) | 0.06 |
| Second layer (an anti-color mixing layer): | |
| Gelatin | 0.64 |
| Anti-color mixing agent (Cpd-4) | 0.10 |
| Solvent (Solv-2) | 0.16 |
| Solvent (Solv-3) | 0.08 |
| Third layer (a green-sensitive magenta color developing layer): | |
| Silver bromochloride emulsion (the same as the emulsion in the third layer in Example 1 except that this emulsion was the 1:3 mixture (Ag mole ratio) of the large size emulsion G1 and the small size emulsion G2) | 0.14 |
| Gelatin | 1.28 |
| Magenta coupler (ExM) | 0.23 |
| Dye image stabilizer (Cpd-9) | 0.03 |
| Dye image stabilizer (Cpd-6) | 0.16 |
| Dye image stabilizer (Cpd-18) | 0.02 |
| Dye image stabilizer (Cpd-2) | 0.02 |
| Solvent (Solv-7) | 0.40 |
| Fourth layer (a UV absorbing layer): | |
| Gelatin | 1.41 |
| UV absorber (UV-3) | 0.47 |
| Anti-color mixing agent (Cpd-4) | 0.05 |
| Solvent (Solv-9) | 0.24 |
| Fifth layer (a red-sensitive cyan color developing layer): | |
| Above silver bromochloride emulsion $R_1$ | 0.20 |
| Gelatin | 1.04 |
| Cyan coupler (ExC') | 0.32 |
| Dye image stabilizer (Cpd-9) | 0.03 |
| Dye image stabilizer (Cpd-18) | 0.02 |
| Dye image stabilizer (Cpd-19) | 0.18 |
| Dye image stabilizer (Cpd-1) | 0.40 |
| Dye image stabilizer (Cpd-20) | 0.05 |
| Solvent (Solv-10) | 0.14 |
| Sixth layer (a UV absorbing layer): | |
| Gelatin | 0.48 |
| UV absorber (UV-3) | 0.16 |
| Anti-color mixing agent (Cpd-4) | 0.02 |
| Solvent (Solv-9) | 0.08 |
| Seventh layer (a protective layer): | |
| Gelatin | 1.10 |
| Acryl-modified copolymer of polyvinyl alcohol (a modification degree: 17%) | 0.17 |
| Liquid paraffin | 0.03 |

(ExC') Cyan coupler
1:1 mixture (mole ratio) of

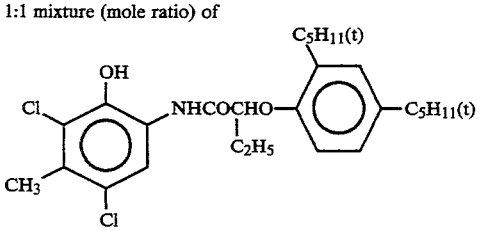

and

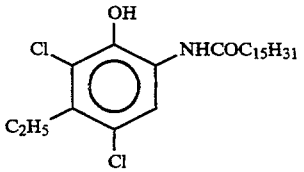

(Cpd-17) Dye image stabilizer

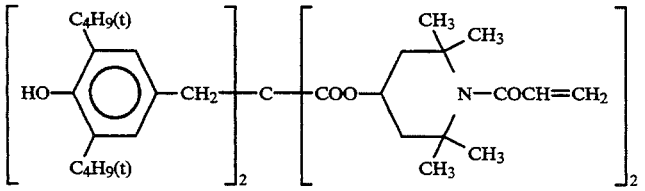

(Cpd-18) Dye image stabilizer

-continued
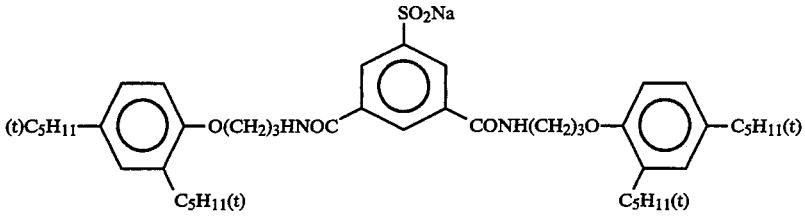
(Cpd-19) Dye image stabilizer
2:4:4 mixture (weight ratio) of
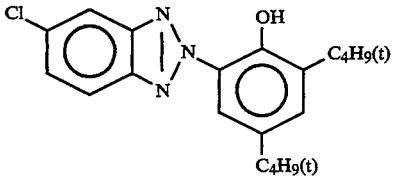
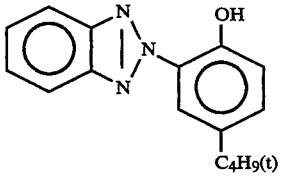
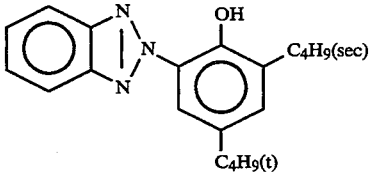
(Cpd-20) Dye image stabilizer
1:1 mixture (weight ratio) of
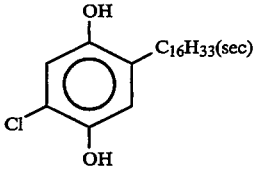
and
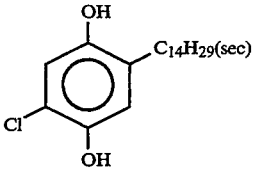
(UV-3) UV absorber
4:2:4 mixture (weight ratio) of
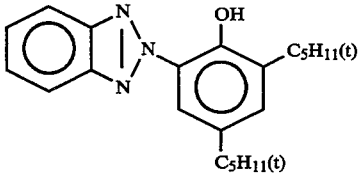
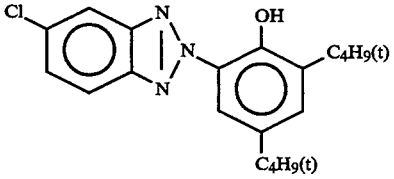

-continued

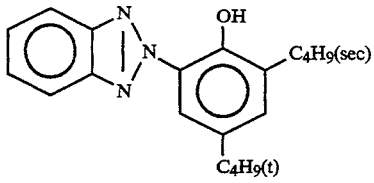

(Solv-7) Solvent
1:1 mixture (volume ratio) of

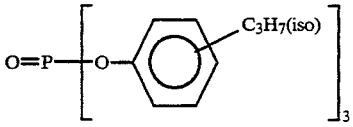

and

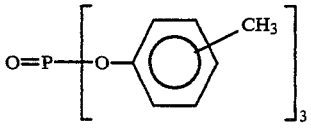

(Solv-8) Solvent $O{=}P{+}O{-}C_9H_{19}(iso)]_3$ (Solv-9) Solvent $COOC_8H_{17}$
|
$(CH_2)_8$
|
$COOC_8H_{17}$ (Solv-10) Solvent
80:20 mixture (volume ratio) of

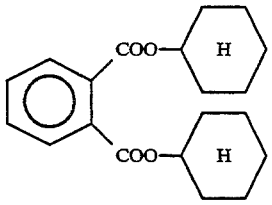

and $C_8H_{17}CHCH{+}CH_2{\rightarrow}_7COOC_8H_{17}$
O

The emulsion and cyan coupler contained in the red-sensitive emulsion layer were replaced as shown in Table 3, and the results obtained are shown in Table 4 below.

TABLE 3

| Sample | Cyan coupler | Red-sensitive emulsion layer |
|---|---|---|
| 201 | ExC' | $R_1$ |
| 202 | ExC' | $R_2$ |
| 203 | ExC' | $R_3$ |
| 204 | (19) | $R_1$ |
| 205 | (19) | $R_2$ |
| 206 | (19) | $R_3$ |
| 207 | (11) | $R_1$ |
| 208 | (11) | $R_2$ |
| 209 | (11) | $R_3$ |

TABLE 4

| Sample | $\Delta S_1$ (Sa–Sb) | $\Delta S_2$ (Sa–Sc) | $\Delta\gamma_1$ ($\gamma$a–$\gamma$b) | $\Delta\gamma_1$ ($\gamma$a–$\gamma$c) | Blue rep.* | Green rep.* |
|---|---|---|---|---|---|---|
| 201 (Comp.) | 0.03 | 0.05 | 0.03 | 0.06 | Δ | Δ |
| 202 (Comp.) | 0.03 | 0.05 | 0.04 | 0.07 | Δ | Δ |
| 203 (Comp.) | 0.02 | 0.03 | 0.03 | 0.05 | Δ | Δ |

TABLE 4-continued

| Sample | $\Delta S_1$ (Sa–Sb) | $\Delta S_2$ (Sa–Sc) | $\Delta\gamma_1$ ($\gamma$a–$\gamma$b) | $\Delta\gamma_1$ ($\gamma$a–$\gamma$c) | Blue rep.* | Green rep.* |
|---|---|---|---|---|---|---|
| 204 (Comp.) | 0.07 | 0.13 | 0.13 | 0.19 | ◎ | ○ |
| 205 (Inv.) | 0.03 | 0.03 | 0.03 | 0.05 | ◎ | ○ |
| 206 (Inv.) | 0.03 | 0.03 | 0.04 | 0.05 | ◎ | ○ |
| 207 (Comp.) | 0.07 | 0.12 | 0.13 | 0.21 | ◎ | ◎ |
| 208 (Inv.) | 0.02 | 0.03 | 0.03 | 0.05 | ◎ | ◎ |
| 209 (Inv.) | 0.03 | 0.03 | 0.04 | 0.05 | ◎ | ◎ |

*Color reproduction

It can be found from the results summarized in Table 4 that the same effects as those obtained in Example 1 were achieved as well in this layer constitution by the combination of the cyan couplers of the present invention and the emulsions subjected to gold sensitization.

EXAMPLE 3

Samples 301 to 309 were prepared in the same manner as those in Samples 101 to 109 except that whole gelatins contained in the respective light-sensitive materials were replaced with gelatin $\alpha$ having a reduced calcium content, as shown in Table 5. In these 18 kinds of the samples, the sample x in which the fifth layer (the red-sensitive emulsion layer) coating solution was coated immediately after it was prepared, the sample y in which the coating solution was coated after it was stored at 40° C. for 2 hours, and the sample z in which the coating solution was coated after it was stored at 40° C. for 8 hours were prepared for each of the samples. The red sensitivities Sx, Sy and Sz were obtained in the same manner as that in Example 1 and Sx−Sy ($\Delta S_1$) and Sx−Sz ($\Delta S_2$) were settled as the standard for the storage stability of the coating solutions.

The sample z in which the coating solution was coated after it was stored at 40° C. for 8 hours was evaluated as well in the same manner as that in Example 1.

Gelatin α having less calcium content was prepared by subjecting gelatin used in Example 1 to a lime treatment to remove calcium. There was measured the whole calcium content in the light-sensitive materials of above Samples 301 to 309 prepared by using this gelatin α to find that it was 6.4 mg/m$^2$. Meanwhile, the whole calcium content in the light-sensitive materials in which gelatin subjected to no decalcium treatment was 30.5 mg/m$^2$.

The results obtained are shown in Tables 5 and 6 below.

TABLE 5

| Sample | Kind of Gelatin | $\Delta S_1$ | $\Delta S_2$ | Remarks |
|---|---|---|---|---|
| 101 | Non-treated gelatin | 0.02 | 0.05 | Comp. |
| 102 | Non-treated gelatin | 0.03 | 0.05 | Comp. |
| 103 | Non-treated gelatin | 0.02 | 0.06 | Comp. |
| 104 | Non-treated gelatin | 0.01 | 0.02 | Comp. |
| 105 | Non-treated gelatin | 0.00 | 0.02 | Inv. |
| 106 | Non-treated gelatin | 0.01 | 0.03 | Inv. |
| 107 | Non-treated gelatin | 0.01 | 0.02 | Comp. |
| 108 | Non-treated gelatin | 0.01 | 0.02 | Inv. |
| 109 | Non-treated gelatin | 0.01 | 0.02 | Inv. |
| 301 | Gelatin α | 0.04 | 0.11 | Comp. |
| 302 | Gelatin α | 0.04 | 0.10 | Comp. |
| 303 | Gelatin α | 0.05 | 0.09 | Comp. |
| 304 | Gelatin α | 0.01 | 0.03 | Comp. |
| 305 | Gelatin α | 0.01 | 0.03 | Inv. |
| 306 | Gelatin α | 0.01 | 0.03 | Inv. |
| 307 | Gelatin α | 0.01 | 0.03 | Comp. |
| 308 | Gelatin α | 0.01 | 0.03 | Inv. |
| 309 | Gelatin α | 0.01 | 0.02 | Inv. |

TABLE 6

| Sample | $\Delta S_1$ (Sa-Sb) | $\Delta S_2$ (Sa-Sb) | $\Delta\gamma_1$ (γa-γb) | $\Delta\gamma_2$ (γa-γc) | Blue-reproducibility | Green-reproducibility | Remarks |
|---|---|---|---|---|---|---|---|
| 101 | 0.03 | 0.05 | 0.06 | 0.08 | Δ | Δ | Comp. |
| 102 | 0.04 | 0.04 | 0.06 | 0.07 | Δ | Δ | Comp. |
| 103 | 0.03 | 0.05 | 0.08 | 0.08 | Δ | Δ | Comp. |
| 104 | 0.06 | 0.12 | 0.11 | 0.20 | ◎ | ○ | Comp. |
| 105 | 0.02 | 0.04 | 0.05 | 0.07 | ◎ | ○ | Inv. |
| 106 | 0.03 | 0.04 | 0.05 | 0.07 | ◎ | ○ | Inv. |
| 107 | 0.07 | 0.12 | 0.13 | 0.21 | ◎ | ○ | Comp. |
| 108 | 0.03 | 0.03 | 0.03 | 0.06 | ◎ | ◎ | Inv. |
| 109 | 0.03 | 0.03 | 0.05 | 0.05 | ◎ | ◎ | Inv. |
| 301 | 0.06 | 0.10 | 0.07 | 0.11 | Δ | Δ | Comp. |
| 302 | 0.03 | 0.03 | 0.04 | 0.05 | Δ | Δ | Comp. |
| 303 | 0.03 | 0.03 | 0.05 | 0.06 | Δ | Δ | Comp. |
| 304 | 0.07 | 0.13 | 0.13 | 0.21 | ◎ | ◎ | Comp. |
| 305 | 0.02 | 0.03 | 0.03 | 0.06 | ◎ | ◎ | Inv. |
| 306 | 0.02 | 0.03 | 0.04 | 0.05 | ◎ | ◎ | Inv. |
| 307 | 0.08 | 0.15 | 0.10 | 0.20 | ◎ | ◎ | Comp. |
| 308 | 0.02 | 0.02 | 0.04 | 0.05 | ◎ | ◎ | Inv. |
| 309 | 0.02 | 0.03 | 0.04 | 0.05 | ◎ | ◎ | Inv. |

The effects of the present invention are apparent from the results summarized in Tables 5 and 6. That is, in Samples 305 to 309 in which the cyan couplers of the present invention were used, even if a gelatin having reduced calcium content is used, there can be provided the light-sensitive materials in which the degree of desensitization after storing a coating solution is small; an instability in the manufacturing performance can be overcome; a stable photographic performance can be obtained even with a compositional change in the processing solutions; and furthermore processing performance is excellent.

EXAMPLE 4

Preparation of Emulsion R 101

An aqueous solution containing silver nitrate 0.5 mole and an aqueous solution containing sodium chloride 0.4 mole were added to and mixed with a solution prepared by adding sodium chloride 3.3 g to a 3% aqueous solution of lime-treated gelatin at 66° C. while vigorously stirring. Subsequently, an aqueous solution containing silver nitrate 0.45 mole and an aqueous solution containing sodium chloride 0.36 mole and potassium bromide 0.09 mole were added and mixed at 66° C. while vigorously stirring. Thereafter, the emulsion was subjected to a desalting in which settling and washing with water were carried out 40° C. Further, lime-treated gelatin 90.0 g was added and pH and pAg of the emulsion were adjusted. Then, triethyl thiourea was added to subject the emulsion to an optimum chemical sensitization so that a surface latent image type emulsion was obtained. The emulsion thus obtained was designated as R 101.

Preparation of Emulsion R 102

An emulsion was prepared in the same manner as that in Emulsion R 101 except that the halide ion aqueous solution added at the first time was replaced with an aqueous solution containing sodium chloride 0.45 mole and potassium bromide 0.05 mole and that the halide ion aqueous solution added at the second time was replaced an aqueous solution containing sodium chloride 0.405 mole and potassium bromide 0.045 mole. The emulsion thus obtained was designated as R 102.

Preparation of Emulsion R 103

An emulsion was prepared in the same manner as that in Emulsion R 101 except that the silver nitrate aqueous solution and halide ion aqueous solution each added at the first time were replaced with an aqueous solution containing silver nitrate 0.76 mole and an aqueous solution containing sodium chloride 0.76 mole, respectively and that the silver nitrate aqueous solution and the halide ion aqueous solution each added at the second time were replaced with an aqueous solution containing silver nitrate 0.19 mole and an aqueous solution containing sodium chloride 0.095 mole and potassium bromide 0.095 mole, respectively. The emulsion thus obtained was designated as R 103.

Preparation of Emulsion R 104

An aqueous solution containing silver nitrate 0.5 mole and an aqueous solution containing sodium chloride 0.5 mole were added to an aqueous solution prepared by adding sodium chloride 3.3 g to a 3% aqueous solution of lime-treated gelatin at 66° C. while vigorously stirring. Subsequently, an aqueous solution containing silver nitrate 0.431 mole and an aqueous solution containing sodium chloride 0.431 mole were added and mixed at 66° C. while vigorously stirring. Further, an aqueous solution containing silver nitrate 0.019 mole and an aqueous solution containing potassium bromide 0.019 mole were added at 66° C. while vigorously stirring, and then the emulsion was subjected to a desalting in which settling and washing with water were carried out at 40° C. Further, lime-treated gelatin 90.0 g was added and pH and pAg of the emulsion were adjusted. Then, triethyl thiourea was added to subject the emulsion to an optimum chemical sensitization so that a surface latent image type emulsion was obtained. The emulsion thus obtained was designated as R 104.

Preparation of Emulsion R 105

An emulsion was prepared in the same manner as that in Emulsion R 104 except that the halide ion aqueous solution added at the second time was replaced with an aqueous solution containing sodium chloride 0.431 mole and potassium hexacyanoferrate (II) trihydrate 0.003 g and that the halide ion aqueous solution added at the third time was replaced with an aqueous solution containing potassium bromide 0.019 mole and potassium hexachloroiridate (IV) 0.2 mg. The emulsion thus obtained was designated as R 105.

Preparation of Emulsion R 106

An aqueous solution containing silver nitrate 0.5 mole and an aqueous solution containing sodium chloride 0.5 mole were added to and mixed with a solution prepared by adding sodium chloride 3.3 g to a 3% aqueous solution of lime-treated gelatin at 66° C. while vigorously stirring. Subsequently, an aqueous solution containing silver nitrate 0.431 mole and the aqueous solution containing sodium chloride 0.431 mole were added and mixed at 66° C. while vigorously stirring. Thereafter, the emulsion was subjected to a desalting in which settling and washing with water were carried out at 40° C. Further, the lime-treated gelatin 90.0 g was added and pH and pAg of the emulsion were adjusted. The silver bromide fine grain emulsion with the grain size of 0.05 μm was added to this emulsion at 50° C. in the silver amount of 0.019 mole to form a silver bromide-rich phase on the grain surface. Then, the emulsion was subjected to an optimum chemical sensitization with triethyl thiourea. The emulsion thus obtained was designated as R 106.

Preparation of Emulsion R 107

The emulsion was prepared in the same manner as that in Emulsion R 106 except that the halide ion aqueous solution added at the second time was replaced with an aqueous solution containing sodium chloride 0.431 mole and potassium hexacyanoferrate (II) trihydrate 0.003 g and further that potassium hexachloroiridate (IV) 0.2 mg per 0.019 mole of silver was allowed to be contained in the silver bromide fine grains during the emulsion grain formation. The emulsion thus obtained was designated as R 107.

The forms of the grains, grain sizes and grain size distributions of the seven kinds of the emulsions R 101 to R 107 thus prepared were obtained from the electron microscopic photographs.

The grain size was represented by the average value of the diameters of the circles having the same areas as the projected areas of the grains. The value obtained by dividing the standard deviation of the grain sizes with the average grain size was used to represent the grain size distribution.

An X ray diffraction from a silver halide crystal was measured to determine the halogen composition of the emulsion grains. The diffraction angle in the diffraction beam from a (200) face was measured in detail with a monochromatized CuKa beam used as a radiating source. While the diffraction beam from a crystal having a uniform halogen composition gives a single peak, the diffraction beam from a silver halide crystal having a silver bromide-rich phase with a different halogen composition gives the plural diffraction patterns corresponding to the compositions thereof. A lattice constant can be calculated from the diffraction angles in the peaks measured to determine the composition of silver halides constituting the crystal.

The results obtained above are summarized in Table 7.

TABLE 7

| Emulsion | Form | Grain size (distribution) | Main peak | Sub-peak | AgBr rich-phase | Polyvalent metal ion |
|---|---|---|---|---|---|---|
| R 101 | Cube | 0.51μ (0.08) | Cl 80% (Br 20%) | — | None | |
| R 102 | Cube | 0.51μ (0.08) | Cl 90% (Br 10%) | — | None | |
| R 103 | Cube | 0.50μ (0.07) | Cl 100% | Cl 50% (Br 50%) | Present | |
| R 104 | Cube | 0.50μ (0.07) | Cl 100% | Cl 61 to 90% | Present | |
| R 105 | Cube | 0.50μ (0.07) | Cl 100% | Cl 61 to 90% | Present | Fe(II), Ir(IV) |
| R 106 | Cube | 0.50μ (0.07) | Cl 100% | Cl 61 to 90% | Present | |
| R 107 | Cube | 0.50μ (0.07) | Cl 100% | Cl 61 to 90% | Present | Fe(II), Ir(IV) |

A paper support laminated on the both sides thereof with polyethylene, which was subjected to a corona discharge treatment, was provided with a gelatin subbing layer containing sodium dodecylbenzenesulfonate, and further was coated with the various photographic constitutional layers, whereby the multilayered color photographic paper (Sample 401) having the following layer constitution was prepared. The coating solutions were prepared in the following manner.

Preparation of the First Layer Coating Solution

Ethyl acetate 180.0 ml, the solvent (Solv-1) 25 g and the solvent (Solv-2) 25 g were added to the yellow coupler (ExY) 153.0 g, the dye image stabilizer (Cpd-1) 15.0 g, the dye image stabilizer (Cpd-2) 7.5 g, and the dye image stabilizer (Cpd-3) 16.0 g to dissolve them, and this solution was emulsified and dispersed in a 10% gelatin aqueous solution 1000 g containing a 10% sodium dodecylbenzenesulfonate aqueous solution 60 ml and citric acid 10 g, to thereby prepare the emulsified dispersion A'. Meanwhile, there was prepared the silver bromochloride emulsion B' (cube, the 6:4 mixture (Ag mole ratio) of the large size emulsion with the average grain size of 0.88 μm and .the small size emulsion with the average grain size of 0.70 μm, wherein the fluctuation coefficients in the grain size distributions were 0.08 and 0.10, respectively, and either size emulsions contained the grains in which silver bromide 0.3 mol % was localized on a part of the grain surface).

The foregoing emulsified dispersion A' and this silver bromochloride emulsion B' were mixed and dissolved, whereby the first layer coating solution was prepared so that it was of the following composition.

Preparation of the Fifth Layer Coating Solution

Ethyl acetate 30.8 ml, the solvent (Solv-6) 12.7 g and the solvent (Solv-1) 0.58 g were added to the cyan coupler (ExC) 19.1 g, the UV absorber (UV-2) 10.4 g, the dye image stabilizer (Cpd-1) 19.1 g, the dye image stabilizer (Cpd-9) 0.58 g, the dye image stabilizer (Cpd-10) 8.7 g, the dye image stabilizer (Cpd-11) 8.7 g, the dye image stabilizer (Cpd-8) 0.58 g, and the dye image stabilizer (Cpd-12) 0.58 g to dissolve them. This solution was added to a 20% gelatin aqueous solution 265 ml containing a 10% sodium dodecylbenzenesulfonate solution 37 ml and then was emulsified and dispersed with a supersonic homogenizer. This emulsified dispersion and the above emulsion R 101 were mixed and dissolved, whereby the fifth layer coating solution was prepared so that it was of the following composition.

The coating solutions for the 2nd layer to 4th layer, the 6th layer and the 7th layer were prepared in the same manner as that in the fifth layer coating solution. Sodium 1-oxy-3,5-dichloro-s-triazine was used as the hardener for the respective layers.

Further, Cpd-15 and Cpd-16 were added to the respective layers so that the whole amounts thereof became 25.0 mg/m$^2$ and 50.0 mg/m$^2$, respectively.

Sensitizing dyes A to E (spectral sensitizing dyes) were used for the silver bromochloride emulsions contained in the respective light-sensitive emulsion layers in the same manner as in Example 1.

Further, the following compound was added to the red-sensitive layer in the amount of $2.6\times10^{-3}$ mole per mole of silver halide:

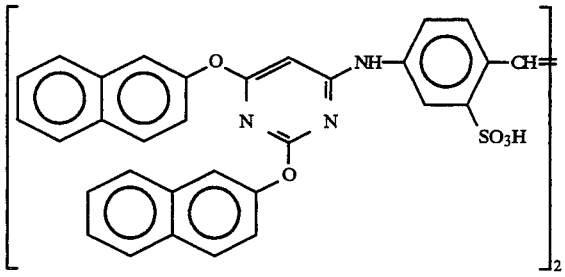

Further, 1-(5-methylureidophenyl)-5-mercaptotetrazole was added to the blue-sensitive layer, green-sensitive layer and red-sensitive layer in the amounts of $3.4\times10^{-4}$ mole, $9.7\times10^{-4}$ mole and $5.5\times10^{-4}$ mole per mole of silver halide, respectively.

Further, 4-hydroxy-6-methyl-1,3,3a,7-tetrazaindene was added to the blue-sensitive layer and green-sensitive layer in the amounts of $1\times10^{-4}$ mole and $2\times10^{-4}$ mole per mole of silver halide, respectively.

The following dye (the numeral in the parenthesis represents a coated amount) was added to the emulsion layers to prevent an irradiation:

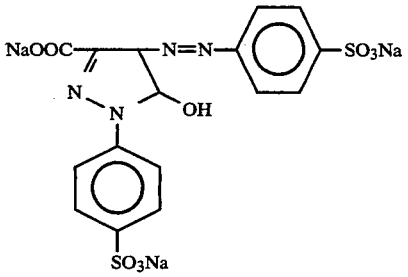

(10 mg/m$^2$)

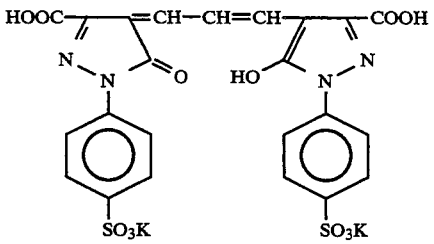

(10 mg/m$^2$)

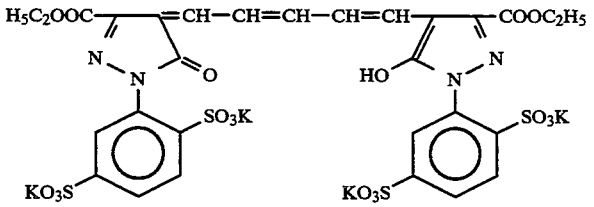

(40 mg/m$^2$)

and

-continued

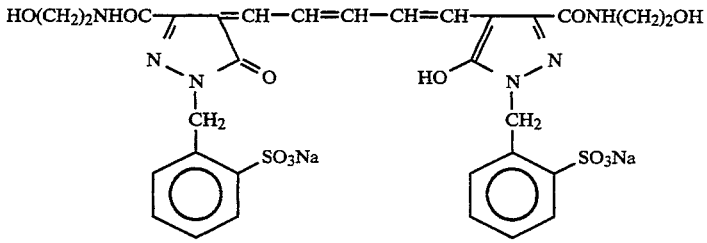

(20 mg/m²)

Layer Constitution

The compositions of the respective layers are shown below. The numerals represent the coated amounts (g/m²). The coated amounts of the silver halide emulsions are expressed in terms of the amounts converted to silver.

Support:

Polyethylene laminated paper [polyethylene coated on the 1st layer side contains a white pigment (titanium oxide) and a blue dye (ultramarine)].

| | |
|---|---|
| First layer (a blue-sensitive emulsion layer): | |
| Above silver bromochloride emulsion B' | 0.27 |
| Gelatin | 1.36 |
| Yellow coupler (ExY) | 0.79 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |
| Second layer (an anti-color mixing layer): | |
| Gelatin | 0.99 |
| Anti-color mixing agent (Cpd-4) | 0.08 |
| Solvent (Solv-2) | 0.25 |
| Solvent (Solv-3) | 0.25 |
| Third layer (a green-sensitive emulsion layer): | |
| Silver bromochloride emulsion (cube, 6:4 mixture (Ag mole ratio) of the large size emulsion having the average grain size of 0.55 μm and the small size emulsion having the average grain size of 0.39 μm, wherein the fluctuation coefficients in the grain size distributions were 0.10 and 0.08, respectively, and either size emulsions comprised the grains in which silver bromide 0.8 mol % was localized on a part of the grain surface and the rest was silver chloride) | 0.13 |
| Gelatin | 1.45 |
| Magenta coupler (ExM) | 0.16 |
| Dye image stabilizer (Cpd-6) | 0.15 |
| Dye image stabilizer (Cpd-2) | 0.03 |
| Dye image stabilizer (Cpd-7) | 0.01 |
| Dye image stabilizer (Cpd-8) | 0.01 |
| Dye image stabilizer (Cpd-9) | 0.08 |
| Solvent (Solv-3) | 0.50 |
| Solvent (Solv-4) | 0.15 |
| Solvent (Solv-5) | 0.15 |
| Fourth layer (an anti-color mixing layer): | |
| Gelatin | 0.70 |
| Anti-color mixing agent (Cpd-4) | 0.04 |
| Dye image stabilizer (Cpd-5) | 0.02 |
| Solvent (Solv-2) | 0.18 |
| Solvent (Solv-3) | 0.18 |
| Fifth layer (a red-sensitive emulsion layer): | |
| Above silver bromochloride emulsion R 101 | 0.20 |
| Gelatin | 0.85 |
| Cyan coupler (ExC) | 0.33 |
| UV absorber (UV-2) | 0.18 |
| Dye image stabilizer (Cpd-1) | 0.33 |
| Dye image stabilizer (Cpd-10) | 0.15 |
| Dye image stabilizer (Cpd-11) | 0.15 |
| Dye image stabilizer (Cpd-12) | 0.01 |
| Dye image stabilizer (Cpd-9) | 0.15 |
| Dye image stabilizer (Cpd-8) | 0.01 |
| Solvent (Solv-6) | 0.22 |
| Solvent (Solv-1) | 0.01 |

-continued

| | |
|---|---|
| Sixth layer (a UV absorbing layer): | |
| Gelatin | 0.55 |
| UV absorber (UV-1) | 0.40 |
| Dye image stabilizer (Cpd-13) | 0.15 |
| Dye image stabilizer (Cpd-6) | 0.02 |
| Seventh layer (a protective layer): | |
| Gelatin | 1.13 |
| Acryl-modified copolymer of polyvinyl alcohol (a modification degree: 17%) | 0.15 |
| Liquid paraffin | 0.03 |
| Dye image stabilizer (Cpd-14) | 0.01 |

The compounds used here are the same as those used the preceding Examples.

Further, the samples having the compositions shown in Table 8 were prepared. Where the cyan couplers (the foregoing exemplified compounds 10 and 11) of the present invention were used, the coated amounts of the silver halide emulsion and cyan coupler contained in the fifth layer were 0.1 g/m² and 0.23 g/m², respectively.

The samples were prepared so that the calcium contents in the light-sensitive materials became 16 mg/m² in Samples 401 to 415 and 7 mg/m² in Samples 416 to 422, respectively by changing the mixing ratio of gelatin with the calcium content of 3000 ppm and gelatin with the calcium content of 100 ppm.

Next, each of Samples 401 to 422 was subjected to a gradational exposure via an optical wedge and a red color filter with a densitometer (an FWH type, the color temperature of a light source: 3200° K., manufactured by Fuji Photo Film Co., Ltd.) and then to a color development processing at the following processing steps.

The color development processing was carried out on the following conditions to thereby obtain three kinds of the processed samples:

1: 30 seconds processing in a fresh color developing solution;

2: 45 seconds processing in a fresh color developing solution;

3: Sample 401 was subjected to an exposure of a grey color with an automatic printer for a color paper (FAP-3500, manufactured by Fuji Photo Film Co., Ltd.) so that about 30% of a coated silver amount was developed. The sample thus exposed was subjected to a continuous processing (until replenishing was carried out by double amount as much as a tank capacity) with a paper processing machine in the processing solutions having the following compositions at the following steps, whereby the processing solution in a running equilibrium status was prepared. The 45 seconds processing was carried out in this color development equilibrium solution.

| Processing step | Temperature | Time | Replenishing amount* | Tank capacity |
|---|---|---|---|---|
| Color developing | 35° C. | 30 & 45 seconds | 80 ml | 2 l |
| Bleach-fixing | 30 to 35° C. | 45 seconds | 215 ml | 2 l |
| Rinsing | 30° C. | 90 seconds | 350 ml | 1 l |
| Drying | 70 to 80° C. | 60 seconds | | |

*Replenishing amount is per $m^2$ of the light-sensitive material.

The compositions of the respective processing solutions are as follows:

| | Tank Solution | Replenishing solution |
|---|---|---|
| Color developing solution | | |
| Water | 800 ml | 800 ml |
| Ethylenediamine-N,N,N',N'-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidethyl)-3-methyl-4-aminoaniline sulfate | 5.0 g | 7.0 g |
| N,N-bis(carboxymethyl)-hydrazine | 4.0 g | 5.0 g |
| Monosodium N,N-di(sulfoethyl)-hydroxylamine | 4.0 g | 5.0 g |
| Fluorescent whitening agent (Whitex 4B manufactured by Sumitomo Chem. Ind. Co., Ltd.)) | 1.0 g | 2.0 g |
| Water was added to | 1000 ml | 1000 ml |
| pH (25° C.) | 10.05 | 10.45 |

| Bleach-fixing solution (Common to the tank solution and replenishing solution) | |
|---|---|
| Water | 400 ml |
| Ammonium thiosulfate (700 g/liter) | 100 ml |
| Sodium sulfite | 17 g |
| Iron (III) ammonium ethylenediaminetetracetate | 55 g |
| Disodium ethylenediaminetetracetate | 5 g |
| Ammonium bromide | 40 g |
| Water was added to | 1000 ml |
| pH (25° C.) | 6.0 |

-continued

| | Tank Solution | Replenishing solution |
|---|---|---|
| Rinsing solution (Common to the tank solution and replenishing solution) | | |
| Deionized water (contents of calcium and magnesium: each 3 ppm or less) | | |

The processed samples thus obtained were subjected to the measurement of a reflection density to obtain a so-called characteristic curve. A sensitivity was defined by the reciprocal of the exposure giving the density higher by 0.5 than a fog density and expressed by the value relative to the sensitivity of Sample 101 subjected to the 45 seconds processing in the fresh developing solution, which was set at 100. The gradation was shown by the difference between the logarithmic values of the exposures providing the densities of 1.8 and 2.2, respectively. The smaller this value is, the harder the gradation means to be. The results are summarized in Table 8.

Further, in order to evaluate the degree of a desensitization caused when a pressure was exerted in the processing solution, these samples were subjected to an even exposure in the amount necessary to give the developed cyan color density of 0.8, and then to a color development in the running equilibrium solution obtained by subjecting the same samples to the continuous processing in the same manner as the above. The samples thus processed were observed to count the number of a desensitization stripe generated by a pressure. The evaluation results were classified to the following four grades. The results are summarized in Table 8.

| Evaluation | Number of the desensitization stripe generated (per 500 $cm^2$) |
|---|---|
| ◎ | None |
| ○ | 1 to 5 stripes |
| Δ | 6 to 10 stripes |
| X | 11 or more stripe |

TABLE 8

| Sample | Emulsion | Cyan coupler | A*1 S | A*1 G | A*2 S | A*2 G | A*3 S | A*3 G | Desensitization stripe | Ca content*4 (mg/$m^2$) |
|---|---|---|---|---|---|---|---|---|---|---|
| 401 (Comp.) | R 101 | Ex C | 60 | 0.53 | 100 | 0.35 | 98 | 0.35 | Δ | 16 |
| 402 (Comp.) | R 102 | Ex C | 91 | 0.32 | 122 | 0.25 | 119 | 0.28 | Δ | 16 |
| 403 (Comp.) | R 103 | Ex C | 145 | 0.22 | 161 | 0.13 | 159 | 0.22 | X | 16 |
| 404 (Comp.) | R 104 | Ex C | 160 | 0.22 | 179 | 0.11 | 177 | 0.25 | Δ | 16 |
| 405 (Comp.) | R 105 | Ex C | 183 | 0.25 | 191 | 0.13 | 190 | 0.22 | X | 16 |
| 406 (Comp.) | R 106 | Ex C | 162 | 0.23 | 175 | 0.12 | 173 | 0.21 | Δ | 16 |
| 407 (Comp.) | R 107 | Ex C | 186 | 0.26 | 195 | 0.15 | 193 | 0.23 | X | 16 |
| 408 (Comp.) | R 101 | 11* | 65 | 0.50 | 102 | 0.33 | 95 | 0.33 | ○ | 16 |
| 409 (Comp.) | R 102 | 11 | 95 | 0.30 | 124 | 0.23 | 120 | 0.24 | ○ | 16 |
| 410 (Inv.) | R 103 | 11 | 103 | 0.19 | 166 | 0.12 | 159 | 0.16 | Δ-○ | 16 |
| 411 (Inv.) | R 104 | 11 | 175 | 0.20 | 183 | 0.09 | 179 | 0.14 | ○ | 16 |
| 412 (Inv.) | R 105 | 11 | 185 | 0.22 | 196 | 0.11 | 191 | 0.14 | Δ-○ | 16 |
| 413 (Inv.) | R 106 | 11 | 169 | 0.22 | 179 | 0.09 | 175 | 0.13 | ○ | 16 |
| 414 (Inv.) | R 107 | 11 | 188 | 0.23 | 199 | 0.12 | 195 | 0.12 | Δ-○ | 16 |
| 415 (Inv.) | R 107 | 10* | 181 | 0.23 | 191 | 0.12 | 187 | 0.14 | Δ-○ | 16 |
| 416 (Comp.) | R 107 | Ex C | 186 | 0.26 | 195 | 0.15 | 193 | 0.23 | Δ | 7 |
| 417 (Inv.) | R 103 | 11 | 103 | 0.19 | 166 | 0.12 | 165 | 0.16 | ◎ | 7 |
| 418 (Inv.) | R 104 | 11 | 175 | 0.20 | 183 | 0.09 | 180 | 0.14 | ◎ | 7 |
| 419 (Inv.) | R 105 | 11 | 185 | 0.22 | 196 | 0.11 | 192 | 0.14 | ◎ | 7 |
| 420 (Inv.) | R 106 | 11 | 169 | 0.22 | 179 | 0.09 | 175 | 0.13 | ◎ | 7 |
| 421 (Inv.) | R 107 | 11 | 188 | 0.23 | 199 | 0.12 | 195 | 0.12 | ◎ | 7 |

TABLE 8-continued

| Sample | Emulsion | Cyan coupler | A*1 S | A*1 G | A*2 S | A*2 G | A*3 S | A*3 G | Desensitization stripe | Ca content*4 (mg/m²) |
|---|---|---|---|---|---|---|---|---|---|---|
| 422 (Inv.) | R 107 | 10 | 181 | 0.23 | 191 | 0.12 | 188 | 0.14 | ◎ | 7 |

*Cyan coupler of the present invention.
S: sensitivity.
G: gradation.
*1: 30 seconds processing in the fresh developing solution.
*2: 45 seconds processing in the fresh developing solution.
*3: 45 seconds processing in running developing solution.
*4: Calcium content in the light-sensitive material.

As apparent from the results shown in Table 8, where the emulsions having the high silver bromide contents are used, a development is unpractically slow and a gradation is soft (Samples 401 and 408). Meanwhile, in the high silver chloride emulsions having no silver bromide-rich phase, the development is fast and the gradation is relatively hard. However, the sensitivity is also unpractically low (Samples 402 and 409). Further, in the samples in which the cyan coupler ExC different from the cyan coupler of the present invention and the high silver chloride emulsion are used, the gradation is liable to soften in processing in the running solution more than in processing in the fresh developing solution (Samples 402 and 406). On the contrary, in Samples 410 to 415 each having the constitution of the present invention, there can be obtained the light-sensitive materials capable of rapidly processing with the small softening in processing in the running (equilibrium) developing solution and the high sensitivity. Further, it can be found that the change from the coupler ExC different from the coupler of the present invention to the cyan coupler of the present invention reduces the desensitization stripes generated when the emulsion provided with the silver bromide-rich phase is used (comparison of Sample 403 with Sample 410). Accordingly, the light-sensitive materials capable of rapidly processing and providing less softening and desensitization stripes in the continuous processing can be obtained only by the present invention. Further, it can be found that where the calcium content in the light-sensitive material is reduced (Samples 416 to 422), in the Samples 417 to 422 in which the cyan couplers of the present invention are used, the desensitization stripes are reduced further more than in Sample 416 in which the coupler ExC different from the coupler of the present invention is used and that they are more preferred embodiments.

EXAMPLE 5

Emulsions R 201 to R 207 were prepared in the same manner as that in Example 4 except that the emulsions were subjected to an optimum chemical sensitization with triethyl thiourea and chlorauric acid. Next, there were prepared the samples in which the yellow coupler (ExY) contained in the first layer (the blue-sensitive layer) in Samples 401 to 422 in Example 4 was replaced with ExY-2 in the same mole, the coated amount in the first layer including that of the coupler was reduced to 80% without changing the composition thereof, and further the emulsion contained in the fifth layer (the red-sensitive layer) was replaced with the above emulsions R 201 to R 207 as shown in Table 9. These samples were evaluated in the same manner as that in Example 4 and the results thereof are summarized in Table 9. Provided that the 30 seconds processing in the fresh developing solution was omitted.

TABLE 9

| Sample | Emulsion | Cyan coupler | B*1 S | B*1 G | C*2 S | C*2 G | Desensitization stripe | Ca content*3 (mg/m²) |
|---|---|---|---|---|---|---|---|---|
| 501 (Comp.) | R 201 | Ex C | 100 | 0.30 | 94 | 0.32 | Δ | 16 |
| 502 (Comp.) | R 202 | Ex C | 122 | 0.13 | 116 | 0.15 | Δ | 16 |
| 503 (Comp.) | R 203 | Ex C | 150 | 0.10 | 144 | 0.25 | X | 16 |
| 504 (Comp.) | R 204 | Ex C | 180 | 0.10 | 175 | 0.21 | Δ | 16 |
| 505 (Comp.) | R 205 | Ex C | 193 | 0.12 | 188 | 0.23 | X | 16 |
| 506 (Comp.) | R 206 | Ex C | 179 | 0.11 | 174 | 0.22 | Δ | 16 |
| 507 (Comp.) | R 207 | Ex C | 195 | 0.13 | 191 | 0.23 | X | 16 |
| 508 (Comp.) | R 201 | 11 | 103 | 0.30 | 99 | 0.32 | ○ | 16 |
| 509 (Comp.) | R 202 | 11 | 128 | 0.11 | 124 | 0.13 | ○ | 16 |
| 510 (Inv.) | R 203 | 11 | 155 | 0.10 | 151 | 0.15 | Δ-○ | 16 |
| 511 (Inv.) | R 204 | 11 | 186 | 0.10 | 182 | 0.13 | ○ | 16 |
| 512 (Inv.) | R 205 | 11 | 199 | 0.11 | 194 | 0.14 | Δ-○ | 16 |
| 513 (Inv.) | R 206 | 11 | 185 | 0.10 | 181 | 0.12 | ○ | 16 |
| 514 (Inv.) | R 207 | 11 | 200 | 0.11 | 196 | 0.13 | Δ-○ | 16 |
| 515 (Inv.) | R 207 | 10 | 192 | 0.11 | 188 | 0.13 | Δ-○ | 16 |
| 516 (Comp.) | R 207 | Ex C | 195 | 0.13 | 191 | 0.23 | Δ | 7 |
| 517 (Inv.) | R 203 | 11 | 155 | 0.10 | 154 | 0.14 | ◎ | 7 |
| 518 (Inv.) | R 204 | 11 | 186 | 0.10 | 183 | 0.14 | ◎ | 7 |
| 519 (Inv.) | R 205 | 11 | 199 | 0.11 | 198 | 0.13 | ◎ | 7 |
| 520 (Inv.) | R 206 | 11 | 185 | 0.10 | 183 | 0.13 | ◎ | 7 |
| 521 (Inv.) | R 207 | 11 | 200 | 0.11 | 199 | 0.13 | ◎ | 7 |
| 522 (Inv.) | R 207 | 10 | 192 | 0.11 | 191 | 0.15 | ◎ | 7 |

S: sensitivity.
G: gradation.
*1: 45 seconds processing in the fresh developing solution.
*2: 45 seconds processing in the running developing solution.
*3: calcium content in the light-sensitive material.

As apparent from the above results, it can be found that similarly to Example 4, the present invention is effective as well when the chemical sensitization is carried out with chlorauric acid. It also can be found that the present invention is effective even where the yellow coupler is changed to ExY-2.

EXAMPLE 6

The procedure of Example 5 was repeated except that the yellow coupler was replaced with ExY-3 and that the coated amount in the first layer including that of the coupler was reduced to 70% of that in Example 4. The results showed that the present invention was effective even where the yellow coupler was replaced with ExY-3.

EXAMPLE 7

Samples 701 to 712 were prepared and evaluated in the same manners as those in Example 4 except that the layer constitution was changed as follows.

Layer Constitution

The compositions of the respective layers are shown below. The numerals represent the coated amounts (g/m$^2$). The coated amounts of the silver halide emulsions are expressed in terms of the amounts converted to silver.

| | |
|---|---|
| Support: | |
| Polyethylene laminated paper [polyethylene coated on the 1st layer side contains a white pigment (titanium oxide) and a blue dye (ultramarine)]. | |
| First layer (a blue-sensitive emulsion layer): | |
| Above silver bromochloride emulsion B' | 0.30 |
| Gelatin | 1.22 |
| Yellow coupler (ExY) | 0.82 |
| Dye image stabilizer (Cpd-17) | 0.19 |
| Solvent (Solv-8) | 0.18 |
| Solvent (Solv-1) | 0.18 |
| Dye image stabilizer (Cpd-1) | 0.06 |
| Second layer (an anti-color mixing layer): | |
| Gelatin | 0.64 |
| Anti-color mixing agent (Cpd-4) | 0.10 |
| Solvent (Solv-2) | 0.16 |
| Solvent (Solv-3) | 0.08 |
| Third layer (a green-sensitive emulsion layer): | |
| Silver bromochloride emulsion (cube, 1:3 mixture (Ag mole ratio) of the large size emulsion having the average grain size of 0.55 μm and the small size emulsion having the average grain size of 0.39 μm, wherein the fluctuation coefficients in the grain size distributions were 0.10 and 0.08, respectively, and either size emulsions comprised the grains in which silver bromide 0.8 mol % was localized on a part of the surface thereof) | 0.12 |
| Gelatin | 1.28 |
| Magenta coupler (ExM) | 0.23 |
| Dye image stabilizer (Cpd-9) | 0.03 |
| Dye image stabilizer (Cpd-6) | 0.16 |
| Dye image stabilizer (Cpd-18) | 0.02 |

-continued

| | |
|---|---|
| Dye image stabilizer (Cpd-2) | 0.02 |
| Solvent (Solv-7) | 0.40 |
| Fourth layer (a UV absorbing layer): | |
| Gelatin | 1.41 |
| UV absorber (UV-3) | 0.47 |
| Anti-color mixing agent (Cpd-4) | 0.05 |
| Solvent (Solv-8) | 0.24 |
| Fifth layer (a red-sensitive emulsion layer): | |
| Silver bromochloride emulsion (cube, 1:4 mixture (Ag mole ratio) of the large size emulsion having the average grain size of 0.58 μm and the small size emulsion having the average grain size of 0.45 μm, wherein the fluctuation coefficients in the grain size distributions were 0.09 and 0.11, respectively, and either size emulsions comprised the grains in which silver bromide 0.6 mol % was localized on a part of the surface thereof) | 0.23 |
| Gelatin | 1.04 |
| Cyan coupler (ExC") | 0.32 |
| Dye image stabilizer (Cpd-9) | 0.03 |
| Dye image stabilizer (Cpd-18) | 0.02 |
| UV absorber (UV-2) | 0.18 |
| Dye image stabilizer (Cpd-1) | 0.40 |
| Dye image stabilizer (Cpd-20) | 0.05 |
| Solvent (Solv-10) | 0.14 |
| Sixth layer (a UV absorbing layer): | |
| Gelatin | 0.48 |
| UV absorber (UV-3) | 0.16 |
| Anti-color mixing agent (Cpd-4) | 0.02 |
| Solvent (Solv-9) | 0.08 |
| Seventh layer (a protective layer): | |
| Gelatin | 1.10 |
| Acryl-modified copolymer of polyvinyl alcohol (a modification degree: 17%) | 0.17 |
| Liquid paraffin | 0.03 |

(ExC") Cyan coupler

1:1 mixture (mole ratio) of

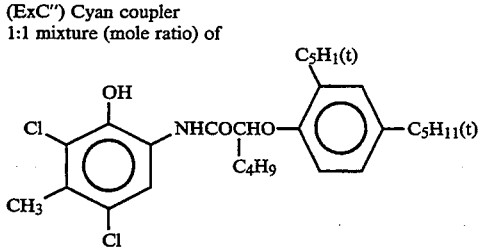

and

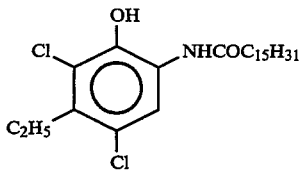

The results are shown in Table 10.

TABLE 10

| Sample | Emulsion | Cyan coupler | B*1 S | B*1 G | C*2 S | C*2 G | Desensitization stripe | Ca content*3 (mg/m$^2$) |
|---|---|---|---|---|---|---|---|---|
| 701 (Comp.) | R 201 | Ex C" | 100 | 0.30 | 96 | 0.32 | Δ | 16 |
| 702 (Comp.) | R 202 | Ex C" | 124 | 0.13 | 120 | 0.15 | Δ | 16 |
| 703 (Comp.) | R 203 | Ex C" | 159 | 0.10 | 142 | 0.25 | X | 16 |
| 704 (Comp.) | R 204 | Ex C" | 183 | 0.10 | 175 | 0.21 | Δ | 16 |
| 705 (Comp.) | R 205 | Ex C" | 197 | 0.12 | 188 | 0.23 | X | 16 |
| 706 (Comp.) | R 206 | Ex C" | 183 | 0.11 | 174 | 0.22 | Δ | 16 |
| 707 (Comp.) | R 207 | Ex C" | 195 | 0.13 | 186 | 0.23 | X | 16 |
| 708 (Comp.) | R 201 | 11 | 106 | 0.30 | 101 | 0.32 | ○ | 16 |
| 709 (Comp.) | R 202 | 11 | 131 | 0.11 | 128 | 0.13 | ○ | 16 |
| 710 (Inv.) | R 203 | 11 | 158 | 0.10 | 154 | 0.15 | Δ-○ | 16 |
| 711 (Inv.) | R 204 | 11 | 189 | 0.10 | 185 | 0.13 | ○ | 16 |
| 712 (Inv.) | R 205 | 11 | 201 | 0.11 | 196 | 0.14 | Δ-○ | 16 |
| 713 (Inv.) | R 206 | 11 | 191 | 0.10 | 187 | 0.12 | ○ | 16 |
| 714 (Inv.) | R 207 | 11 | 207 | 0.11 | 202 | 0.13 | Δ-○ | 16 |
| 715 (Inv.) | R 207 | 10 | 198 | 0.11 | 193 | 0.13 | Δ-○ | 16 |
| 716 (Comp.) | R 207 | Ex C." | 195 | 0.13 | 186 | 0.23 | Δ | 7 |
| 717 (Inv.) | R 203 | 11 | 158 | 0.10 | 154 | 0.15 | | |

TABLE 10-continued

| Sample | Emulsion | Cyan coupler | B*1 S | B*1 G | C*2 S | C*2 G | Desensitization stripe | Ca content*3 (mg/m²) |
|---|---|---|---|---|---|---|---|---|
| 718 (Inv.) | R 204 | 11 | 189 | 0.10 | 185 | 0.13 | Δ-○ | |
| 719 (Inv.) | R 205 | 11 | 201 | 0.11 | 198 | 0.14 | Δ-○ | |
| 720 (Inv.) | R 206 | 11 | 191 | 0.10 | 183 | 0.13 | Δ-○ | |
| 721 (Inv,) | R 207 | 11 | 207 | 0.11 | 204 | 0.12 | Δ-○ | |
| 722 (Inv.) | R 207 | 10 | 198 | 0.11 | 195 | 0.15 | Δ-○ | |

S: sensitivity.
G: gradation.
*1: 45 seconds processing in the fresh developing solution.
*2: 45 seconds processing in the running developing solution.
*3: calcium content in the light-sensitive material.

As apparent from the results, the effects of the present invention are valid even where the layer constitution is changed as shown above and the light-sensitive materials in which the softening generated when the running (equilibrium) developing solution is used is small and the desensitization stripes are reduced can be obtained only by the constitution of the present invention.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support and provided thereon a photographic constitutional layer which comprises at least one layer of each of a light-sensitive silver halide emulsion layer containing a yellow dye-forming coupler, a light-sensitive silver halide emulsion layer containing a magenta dye-forming coupler, and a light-sensitive silver halide emulsion layer containing a cyan dye-forming coupler, and at least one non-light-sensitive layer, wherein the above silver halide emulsion layer containing a cyan dye-forming coupler contains (i) at least one of the pyrroloazole cyan couplers represented by Formula (Ia) in an amount of $1\times10^{-3}$ to 1 mole per mole of silver halide, and (ii) silver bromochloride grains having a silver chloride content of 90 mole % or more or silver chloride grains, each chemically sensitized with a gold compound in an amount of $1\times10^{-8}$ to $1\times10^{-2}$ mole per mole of silver halide:

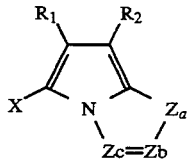

(Ia)

wherein Za represents —NH— or —CH($R_3$)—, and Zb and Zc each represent —C($R_4$)= or —N=; $R_1$, $R_2$ and $R_3$ each represent an electron attractive group having a Hammett's substituent constant $\sigma_p$ of 0.20 or more, provided that the sum of the $\sigma_p$ values of $R_1$ and $R_2$ is 0.65 or more; $R_4$ represents a hydrogen atom or a substituent, provided that when two $R_4$'s are present in the formula, they may be the same or different; X represents a hydrogen atom or a group capable of splitting off upon a reaction with an oxidation product of an aromatic primary amine color developing agent; the group represented by $R_1$, $R_2$, $R_3$, $R_4$ or X may become a divalent group and combine to form a dimer or a polymer higher than a dimer or bond to a high molecular chain to form a homopolymer or a copolymer, and the whole amount of calcium contained in the photographic constitutional layer is 15 mg or less per m² of the light-sensitive material.

2. The light-sensitive material as claimed in claim 1, wherein said pyrroloazole cyan coupler is represented by Formula (IIa), (IIIa) or (IVa):

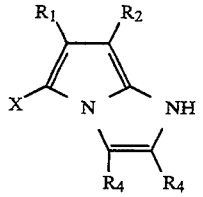

(IIa)

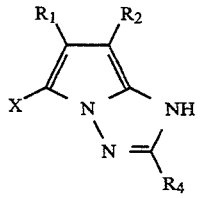

(IIIa)

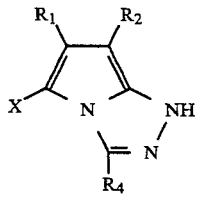

(IVa)

wherein $R_1$, $R_2$, $R_3$, $R_4$ and X are as defined in Formula (Ia).

3. The light-sensitive material as claimed in claim 1, wherein the coating amount of said pyrroloazole cyan coupler is $2.0\times10^{-6}$ to $2.0\times10^{-3}$ mole per m² of the light-sensitive material.

4. The light-sensitive material as claimed in claim 1, wherein the halogen composition of said silver halide grains is of silver chloride or silver bromochloride containing 98 mole % or more of silver chloride.

5. The light-sensitive material as claimed in claim 1, wherein said silver halide grains are silver bromochloride grains having a silver bromide-localized phase in which the silver bromide content is larger by at least 10 mole % than that of the other portions.

6. The light-sensitive material as claimed in claim 5, wherein said silver bromide-localized phase contains 10 to 60 mole % of silver bromide.

7. The light-sensitive material as claimed in claim 1, wherein $R_1$, $R_2$ and $R_3$ are each independently selected from the group consisting of an acyl group, an acyloxy group, a carbamoyl group, an alkoxycarbonyl group, an aryloxycarbonyl group, a cyano group, a nitro group, an alkysulfinyl group, an arylsulfinyl group, an alkylsulfonyl group, an arylsulfonyl group, a sulfamoyl group, a halogenated alkyl group, a halogenated alkoxy group, a halogenated alkylthio group, a halogenated aryloxy group, a halogenated aryl group, an aryl group substituted with two or more nitro groups, and a heterocyclic group, and $R^4$ is selected from the group consisting of hydrogen, an alkyl group, an aryl group, a heterocyclic group, a cyano group, a nitro group, an acylamino group, an arylamino group, a ureido group, a sulfamoylamino group, an alkylthio group, an arylthio group, a heterocyclic-thio group, an alkoxycarbonylamino group, an aryloxycarbonylamino group, a sulfonamide group, a carbamoyl group, a sulfamoyl group, a sulfonyl group, an alkoxycarbonyl group an aryloxycarbonyl group, a heterocyclic-oxy group, an acyloxy group, a carbamoyloxy group, an imide group, a sulfinyl group, a phosphonyl group, an acyl group, and an azolyl group.

8. The light-sensitive material as claimed in claim 1, wherein the whole amount of calcium contained in said photographic constitutional layer is 2 to 8 mg/m$^2$.

9. A silver halide color photographic light-sensitive material comprising a support and provided thereon a photographic constitutional layer which comprises at least one layer of each of a light-sensitive silver halide emulsion layer containing a yellow dye-forming coupler, a light-sensitive silver halide emulsion layer containing a magenta dye-forming coupler, and a light-sensitive silver halide emulsion layer containing a cyan dye-forming coupler, and at least one non-light-sensitive layer, wherein the above silver halide emulsion layer containing a cyan dye-forming coupler contains (i) at least one of the pyrroloazole cyan couplers represented by Formula (Ia) in an amount of $1\times10^{-3}$ to 1 mole per mole of silver halide, and (ii) silver bromochloride grains containing substantially no silver iodide and having a silver chloride content of 90 mole % or more and a silver bromide-rich phase on the grain surface or in the inside thereof having a silver bromide content larger by 5 mole % or more than those at the other portions:

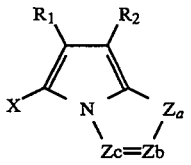

(Ia)

wherein Za represents —NH— or —CH($R_3$)—, and Zb and Zc each represent —C($R_4$)= or —N=; $R_1$, $R_2$ and $R_3$ each represent an electron attractive group having a Hammett's substituent constant $\sigma_p$ of 0.20 or more, provided that the sum of the $\sigma_p$ values of $R_1$ and $R_2$ is 0.65 or more; $R_4$ represents a hydrogen atom or a substituent, provided that when two $R_4$'s are present in the formula, they may be the same or different; X represents a hydrogen atom or a group capable of splitting off upon a reaction with an oxidation product of an aromatic primary amine color developing agent; the group represented by $R_1$, $R_2$, $R_3$, $R_4$ or X may become a divalent group and combine to form a dimer or a polymer higher than a dimer or bond to a high molecular chain to form a homopolymer or a copolymer, and the whole amount of calcium contained in the photographic constitutional layer is 10 mg or less per m$^2$ of the light-sensitive material.

10. The light-sensitive material as claimed in claim 9, wherein said pyrroloazole cyan coupler is represented by Formula (IIa), (IIIa) or (IVa):

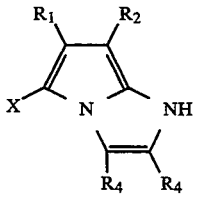

(IIa)

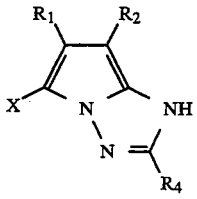

(IIIa)

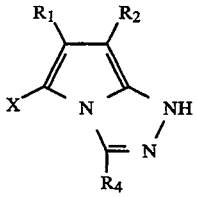

(IVa)

wherein $R_1$, $R_2$, $R_3$ $R_4$ and X are as defined in Formula (Ia).

11. The light-sensitive material as claimed in claim 9, wherein the coating amount of said pyrroloazole cyan coupler is $2.0\times10^{-6}$ to $2.0\times10^{-3}$ mole per m$^2$ of the light-sensitive material.

12. The light-sensitive material as claimed in claim 11, wherein said silver halide grains are chemically sensitized with a gold compound in an amount of $1\times10^{-8}$ to $1\times10^{-2}$ mole per mole of silver halide.

13. The light-sensitive material as claimed in claim 9, wherein said silver bromochloride grains contain 95 to 99.9 mole % of silver chloride.

14. The light-sensitive material as claimed in claim 9, wherein said silver bromide-rich phase has a silver bromide content larger by at least 10 mole % than those at the other portions.

15. The light-sensitive material as claimed in claim 14, wherein said silver bromide-rich phase contains 10 to 60 mole % of silver bromide.

16. The light-sensitive material as claimed in claim 9, wherein $R_1$, $R_2$ and $R_3$ are each independently selected from the group consisting of an acyl group, an acyloxy group, a carbamoyl group, an alkoxycarbonyl group, an aryloxycarbonyl group, a cyano group, a nitro group, an alkysulfinyl group, an arylsulfinyl group, an alkylsulfonyl group, an arylsulfonyl group, a sulfamoyl group, a halogenated alkyl group, a halogenated alkoxy group, a halogenated alkylthio group, a halogenated aryloxy group, a halogenated aryl group, an aryl group substituted with two or more nitro groups, and a heterocyclic group, and $R^4$ is selected from the group consisting of hydrogen, an alkyl group, an aryl group, a heterocyclic group, a cyano group, a nitro group, an acylamino group, an arylamino group, a ureido group, a sulfamoylamino group, an alkylthio group, an arylthio group, a heterocyclic-thio group, an alkoxycarbonylamino group, an aryloxycarbonylamino group, a sulfonamide group, a carbamoyl group, a sulfamoyl group, a sulfonyl group, an alkoxycarbonyl group an aryloxycarbonyl group, a heterocyclic-oxy group, an acyloxy group, a carbamoyloxy group, an imide group, a sulfinyl group, a phosphonyl group, an acyl group, and an azolyl group.

17. The light-sensitive material as claimed in claim 9, wherein the whole amount of calcium contained in said photographic constitutional layer is 2 to 8 $mg/m^2$.

* * * * *